US005516473A

United States Patent [19]

Bakeev et al.

[11] Patent Number: 5,516,473

[45] Date of Patent: May 14, 1996

[54] IMBIBITION PROCESS

[75] Inventors: Nikolai P. Bakeev; Gennadii M. Lukovkin, both of Moscow, Russian Federation; Ilan Marcus, Versoix, Switzerland; Anatolii E. Mikushev; nikolai A. Shitov, both of Tver, Russian Federation; Bernhard E. Vanissum, Onex, Switzerland; Alexandr L. Volynskii, Moscow, Russian Federation

[73] Assignee: E. I. Du Pont de Nemours and Company, Wilmington, Del.

[21] Appl. No.: 314,731

[22] Filed: Sep. 29, 1994

Related U.S. Application Data

[63] Continuation-in-part of Ser. No. 129,642, Sep. 30, 1993, abandoned.

[30] Foreign Application Priority Data

Sep. 30, 1993 [RU] Russian Federation ..... 93/050,134

[51] Int. Cl.[6] ..... B29C 55/04; B29C 67/00

[52] U.S. Cl. ..... 264/154; 264/289.3; 264/289.6; 264/340; 264/345

[58] Field of Search ..... 264/154, 289.3, 264/289.6, 340, 345

[56] References Cited

U.S. PATENT DOCUMENTS

| | | | |
|---|---|---|---|
| 2,877,500 | 3/1959 | Rainer et al. | 264/22 |
| 3,102,323 | 9/1963 | Adams | 264/289.6 X |
| 3,233,019 | 1/1966 | Adams | 264/289.6 X |
| 3,293,339 | 12/1966 | Gates | 264/289.6 X |
| 4,001,367 | 1/1977 | Guthrie et al. | 264/154 |
| 4,055,702 | 10/1977 | Guthrie et al. | 428/398 |
| 4,911,867 | 3/1990 | Burlet et al. | 264/22 |

FOREIGN PATENT DOCUMENTS

| | | |
|---|---|---|
| 241054 | 10/1987 | European Pat. Off. . |
| 294135 | 12/1988 | European Pat. Off. . |
| 395418 | 12/1965 | Switzerland . |

OTHER PUBLICATIONS

Woods, J. T. I. *Transactions,* 46, 629–631, Sep., 1955.

Volkov, et al., *Journal of Thermal Analysis,* 38, 1311–1322, 1992.

Volynski, et al., *Polymer Science,* 34, 36, 476–477, 1972.

*Primary Examiner*—Leo B. Tentoni

[57] ABSTRACT

A process of imbibition drawing is improved by a pretreatment that preferably involves straining an undrawn filament bundle, or other elongated shaped undrawn or partially drawn synthetic polymeric article, while wetted with a cracking agent, before incorporating a desired additive by imbibition drawing, thereby increasing the imbibition capacity of the article, and improved articles incorporating such additives. Alternatively or in addition the pretreatment involves polarizing irradiation, before imbibition drawing.

21 Claims, 10 Drawing Sheets

IMBIBITION PROCESS

CROSS-REFERENCE TO RELATED APPLICATION

This application is a continuation-in-part of application Ser. No. 08/129,642, filed Sep. 30, 1993, which was allowed but is now being abandoned.

FIELD

This invention concerns improvements in and relating to incorporating finely divided additives into filaments, films, and other elongated shaped articles of synthetic organic polymers by imbibition drawing, including especially improved processes for incorporating finely divided additives such as flame-retardants into such shaped articles, and products therefrom, including the resulting shaped articles incorporating such additives, and including processed filaments and films and products thereof and therefrom, such as garments and fabrics and articles filled with such materials and products.

BACKGROUND OF THE INVENTION

Synthetic organic polymeric materials (hereinafter often synthetic polymers) have been known and produced and used commercially for several decades in very large quantifies. One of the most common of such polymers for several years has been poly(ethylene terephthalate), sometimes referred to as 2G-T, which is a polyester and is currently produced in very large quantifies in the form of oriented structures, such as filaments and films and articles thereof and/or therefrom, such as fabrics and garments. It has long been desired to find a way to reduce the flammability of polyester articles, i.e., shaped articles incorporating (generally oriented) structures of polyester, especially garments and other articles of apparel and fabrics, including filled articles, furnishing articles of and filled with polyester fiber, and polyester films, including tapes, by way of example.

The literature is full of various suggestions for solving this problem, all of which have various disadvantages or difficulties, especially practical and economic, so that there still remains this long-standing problem requiring solution. This problem has not been restricted only to polyesters, but has applied to articles of other synthetic polymers. One solution suggested in the 1950's will now be discussed.

A process of multiple-neck drawing while simultaneously infusing various modifying agents in finely divided form into polymeric articles was disclosed some 30 years ago, by Adams in U.S. Pat. Nos. 3,233,019 and 3,102,323, the disclosures of which are hereby incorporated by reference. Although additives that Adams desired to infuse were mostly dyestuffs, he also disclosed other additives and modifiers, including antistatic agents, light stabilizers and cross-linking agents (col. 2, lines 31–32 of U.S. Pat. No. 3,102,323), and incompatible polymers, lubricants (including silicones), flame-proofing agents and flame retardants, inorganic salts, wetting agents and hydrophobic agents, anti-soilant additives, adhesives and bonding agents were also among those listed (cols. 13–14). His first Examples were of 2G-T filaments imbibing dyestuffs, but he mentioned other polymers, including polyamides (nylons) and polyalkylenes, such as polypropylene and polyethylene. By "modifying agent," Adams meant essentially any substance soluble in the "cracking agent" which was not substantially removed subsequently (col 2, lines 39 et seq of U.S. Pat. No. 3,233,019). Adams disclosed definitions of expressions used herein, including "cracking agent", and referred to an earlier article by Woods (J.T.I. Transactions, vol 46, pages 629–631, September, 1955) discussing the phenomenon of surface cracking of nylon yarn, the disclosure of which is also incorporated herein by reference. Adams taught multiple-neck drawing as a prerequisite for infusing his "modifying agents" (col 3, lines 57–59 of U.S. Pat. No. 3,233,019) and referred to his multiple neck process in his claims and elsewhere (e.g., previous col 2, line 29), but the term "multiple-neck drawing process" was earlier used by Woods (see bottom of col 4 of U.S. Pat. No. 3,102,323). We refer herein to Adams' techniques as "imbibition drawing", which term has become accepted by many. The present invention concerns improvements in the imbibition techniques disclosed several decades ago by Adams. So far as known to us, his process is not being used commercially successfully to incorporate flame-retardants to solve the long standing problem of flame-proofing articles of polyester fibers or films, nor used otherwise commercially.

The lack of successful commercial application of Adams' process has persisted until now, notwithstanding the more recent disclosures by Guthrie et al in U.S. Pat. Nos. 4,001,367 and 4,055,702 of a method for permanently incorporating between 0.1 and 25% by weight of an additive into an undrawn or partially drawn melt spun fiber formed from a polyester, polyamide, polypropylene or high density polyethylene by cold drawing the fibers under conditions that generated a network of interconnecting microvoids within the fiber, and formed in the presence of specified liquid or vapor media (i.e., fluids) which filled the microvoid network at temperatures below the effective glass transition temperature ($T_g$) of the fibers. Guthrie's additives could be virtually any liquid or solid additive that could be dissolved, dispersed or emulsified in a suitable liquid or vapor, and should have a maximum particle size less than two microns. Guthrie's additives could either be present in his drawing medium which filled the microvoid network, or could be applied to a drawn fiber wherein the microvoids contained the drawing medium. In this later alternative, the additive diffused into the microvoids and displaced a portion of the drawing medium. Guthrie's Examples concerned mostly incorporation of phosphorus-containing flame-retardant additives into 2G-T fibers. The flammability of Guthrie's resulting dyed and undyed fabric samples was determined using the Limiting Oxygen Index (LOI). The best (highest) LOI value reported by Guthrie was 28.8 (Example 7, col 15, line 32).

Adams referred to and illustrated the non-uniform axial distribution of modifier in the products of his invention as an unexpected and valuable property (e.g., col 3, lines 23–26 and 35 et seq of U.S. Pat. No. 3,102,323). We believe, however, that the inability of Adams or Guthrie to distribute finely divided modifiers (additives) more uniformly may have been responsible for previous difficulty in "imbibing" relatively large loadings of additive without negatively affecting important properties, such as tensile properties.

More recently, some of the present inventors have published a series of Russian papers on compositions comprising a polymeric matrix and low molecular weight compounds (LMCs) that are incorporated into the matrix via formation of a highly dispersed porous structure of crazes, when polymer drawing takes place in adsorptionally active media (AAM), referred to in the Journal of Thermal Analysis, Vol 38 (1992), 1311–1322, and in Polymer Science, Vol 34, No. 6, 1972, 476–477, each being incorporated herein by reference. We have mostly used herein the terminology "imbibition drawing" and Adams' terminology of "cracking agent", or "cracking fluid" or "cracking liquid". We have also used the term "crazes", which has been used in the art for at least 20 years.

The present invention solves the specific problems referred to above, and provides improvements whereby a wide variety of finely divided additives can be introduced into articles of synthetic polymers, broadly, by process techniques that have many flexible attributes, so are expected to be important and have broad commercial application as will be apparent.

SUMMARY OF THE INVENTION

According to the present invention, we provide an improved process involving imbibition drawing of an undrawn or partially drawn elongated shaped article (hereinafter "said feed article"), e.g., one or more filaments or films, of synthetic organic polymer, whereby finely divided amounts of additive are imbibed into the shaped article as it is drawn in the presence of a fluid and of the additive, characterized in that said feed article is pretreated, before performing the imbibition drawing, to improve the quality (especially the frequency and uniformity) of crazing in the resulting article. The feed article is preferably pretreated by wetting it with a cracking fluid and straining it, while wetted with cracking fluid, before performing the imbibition drawing, whereby a multiplicity of improved crazes are produced in the resulting shaped article by being so pretreated.

The various terms are explained hereinafter and follow essentially these used in the art already mentioned, such as Adams and Guthrie. We believe, however, that it is a highly dispersed porous structure of crazes (in the polymeric article) into which the additive infuses during our imbibition drawing, and that it is by having improved the ability of the fine structure in the polymeric article (probably by having provided a much better porous structure of crazes) by pretreatment according to the invention that we have obtained improvements in imbibition drawing over what we were able to achieve by following the teachings in the art. After imbibition drawing, the crazes can be observed in fully drawn fibers or films as a multiplicity of alternating narrow sections with a different gray shade (or color in case a dye is used), resulting from a difference in refractive index between the crazed and non-crazed sections. Best contrast can usually be achieved with light passing from beneath and through the sample. We believe that only sections corresponding to crazes (before the final drawing) contain infused (imbibed) additive.

As can be readily understood, the essence of the process of the present invention is modification of the process taught by Adams or Guthrie by a "pretreatment" of the feed article (in other words of the undrawn or partially drawn fiber(s), film or other elongated shaped article) before performing the actual imbibition drawing (which latter may generally be performed essentially as taught in the art). The process of the invention provides a dramatic improvement over the results disclosed by Adams or Guthrie as will be related herein. We believe our improvements are caused by or correlate with an increase in the frequency and/or uniformity of crazes in the resulting article, and we have observed in some instances an increase in the frequency and/or uniformity of microcracks or some such characteristics in the pretreated article that undergoes the actual imbibition drawing, as compared to articles subjected to imbibition drawing following Adams' or Guthrie's teachings, e.g., in their working Examples.

We have used more than one type of pretreatment, as disclosed hereinafter. All have had a common feature in that the surface of the feed article has been pretreated to make it more receptive to the subsequent imbibition drawing. Generally, except as indicated hereinafter, the surface of the feed article has been pretreated while wetted by a cracking fluid during the pretreatment. However, as will be discussed hereinafter, pretreatment by polarizing irradiation has been performed on a "dry" feed article, i.e., a feed article that was not wetted with cracking fluid.

Thus, a preferred pretreatment according to the invention involves straining the feed article (while wetted with cracking fluid, before performing the imbibition drawing). Such straining pretreatment may be performed by deforming the feed article as it passes over one or more (preferably two opposed) knife edges in a manner that is somewhat reminiscent of edge crimping and that will be described in more detail hereinafter. However such straining pretreatment is preferably performed by careful stretching or tensioning the feed article (while wetted with cracking fluid and before performing the imbibition drawing). Such tensioning is preferably such as to effect some slight or partial drawing of the feed article that is wetted with cracking fluid (before the actual imbibition drawing). Such partial drawing is preferably vibrationless, and preferably stable. Most conveniently, as hereinafter described, the appropriately tensioned feed article may be wetted with cracking fluid at a clearly defined location so that the desired partial drawing (i.e., straining pretreatment according to the invention) occurs at that precise location because the stress applied is less than the yield point of the feed article in air (i.e., before wetting with the cracking fluid) and the yield point of the feed article is lowered at that location by the wetting of the feed article so the same applied stress is sufficient to effect partial drawing of the now wetted article. The extent of partial drawing may be controlled by conventional means, e.g., by sets of rolls driven at controlled speeds, the ratio of which corresponds to the (partial) draw ratio desired during this pretreatment.

Another method of pretreatment according to the invention is to effect polarization of the surface of the feed article, e.g., by Corona radiation. This may be effected in addition to or instead of straining the feed article. This has been performed before the feed article has been wetted with cracking fluid.

Also provided, according to the invention, are novel filaments, films and elongated shaped articles generally, as indicated hereinafter.

Thus, according to another aspect of the invention, we provide a drawn synthetic organic polymeric elongated shaped article, such as a fiber or film, containing additive imbibed into and distributed along said article, characterized by the presence of alternating sections of polymer of one refractive index and alternating sections of polymer of different refractive index in amount at least 100 sections per mm along said article and by the presence of said additive in essentially only sections of said different refractive index.

An important attribute and advantage of such new drawn articles is that they can contain (infused therein) desired additives and yet still have good tensiles, e.g., have 80% or more of the tensile properties (such as fibers having at least 80% of the break tenacity) of comparable articles that have been drawn (to similar draw ratios in air or water) without imbibition of the additives. This is a significant improvement over the art and makes imbibition drawing practical and economical in contrast to the art.

Particularly advantageous types of fibers according to the invention are hollow fibers, i.e., with one or more continuous voids before infusion of the additive, in the form of polymeric filaments containing correspondingly one or more chamber(s) extending axially and containing additive within said chamber after imbibition drawing.

As already indicated, particularly important articles according to the invention include those wherein the polymer is a polyester or polyamide and the additive is a flame retardant, especially wherein the Limiting Oxygen Index (LOI) of the article is at least 29, e.g., 30 or more. Also important are articles that pass BS 5852 (part II).

A preferred aspect includes polyester fiberfill coated with a polysiloxane slickener, wherein the additive is a flame retardant, e.g., containing phosphorus (P), such as organic phosphonates, phosphines, phosphine oxides, and amides of phosphoric or phosphinic acids, especially such as show a synergistic effect with other P-containing compounds and/or with halogenated organic compounds.

Other additives that are expected to be preferred include those having antibacterial properties and/or hydrophilic properties, dyes, and electrically-conductive materials such as metals or derivatives thereof such as chemicals that are capable of chemical reaction to form an electrically-conductive material by chemical reduction or other reaction process in situ, such as does not destroy the polymeric article, or significantly degrade or otherwise cause an undesirable or significant loss of the properties of the article.

According to a still further aspect are undrawn synthetic organic polymeric shaped articles, such as fibers or films, having a multiplicity of microcracks, as disclosed herein, and including such as may be drawn to propagate microcracks into crazes.

BRIEF DESCRIPTION OF THE DRAWINGS

FIGS. 1 to 8 are magnified photographs (by Scanning Election Microscope, i.e., SEM) as discussed in more detail hereinafter, FIGS. 1, 2, 5, 7 and 8 being of products according to the invention, while FIGS. 3, 4 and 6 are representative of products prepared according to prior art (i.e., Adams).

DETAILED DESCRIPTION OF THE INVENTION

Figure 2:
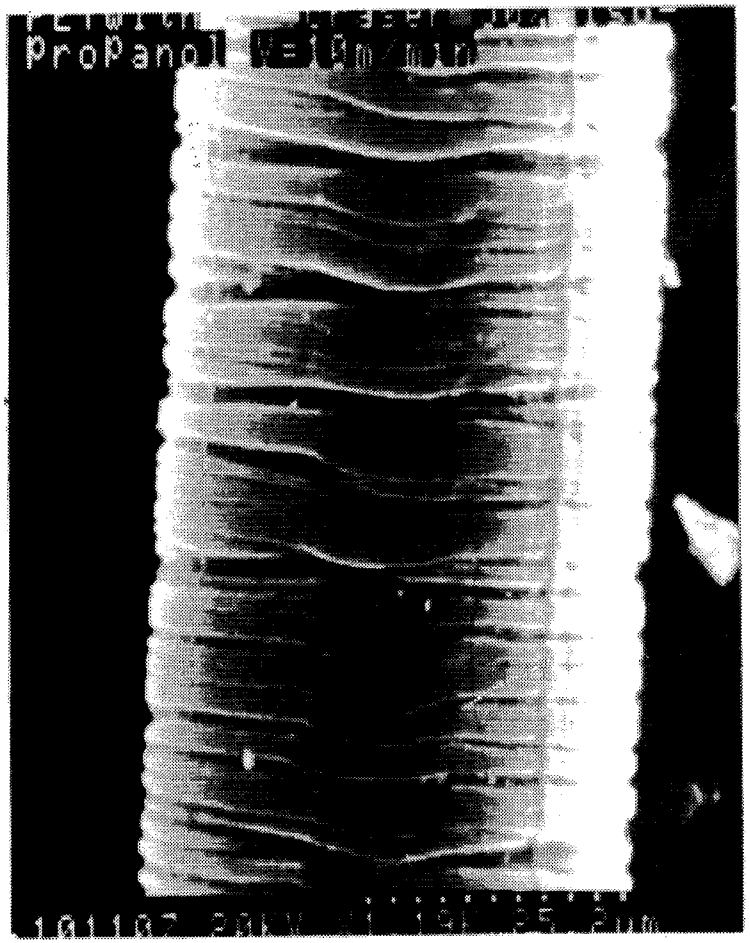
Figure 1:
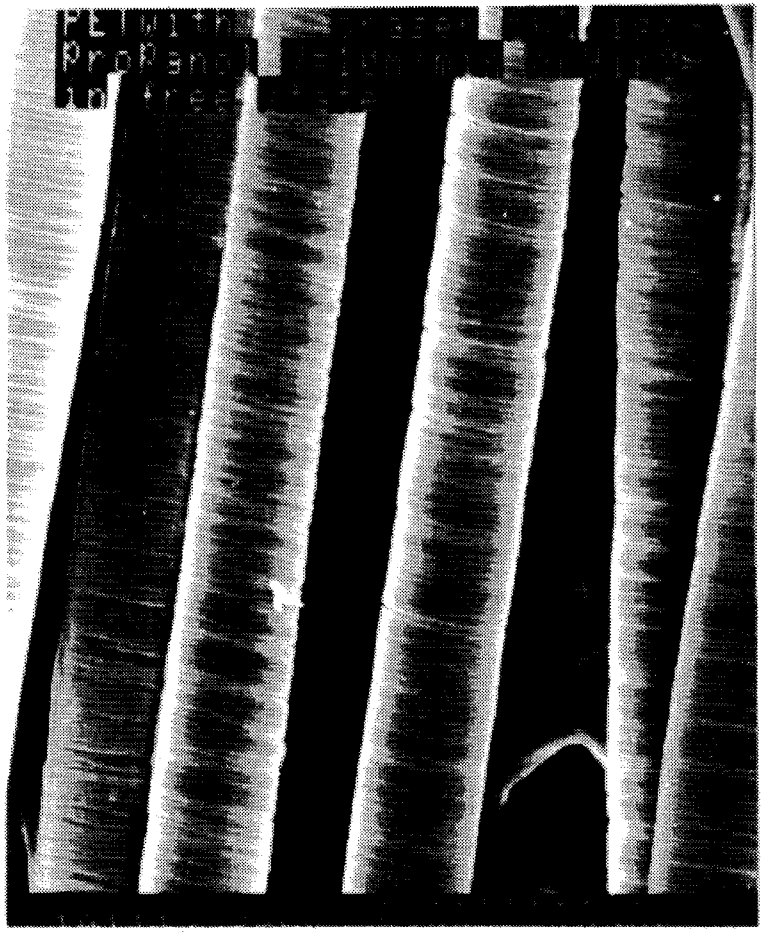

This invention provides an economic method of introducing finely divided additives (generally chemicals) into elongated shaped articles of synthetic undrawn or partially drawn polymers, generally in the form of fibers or films, at concentrations of as much as 30% by weight through the use of imbibition drawing.

By "synthetic organic polymer" we mean especially synthetic linear polyesters, such as poly(ethylene terephthalate), often referred to as homopolymer, or 2G-T, and copolyesters, polyamides, e.g., nylon 66, nylon 6, and copolyamides, polyalkylenes, e.g., polypropylene and polyethylene, and any melt-spun polymers, as disclosed in the art, e.g., mentioned hereinbefore.

By "elongated shaped articles" we mean one or more films or fibers, and including a bundle of one or more continuous filaments, such as can be oriented by drawing. We use herein both terms "fiber" and "filament", and use of the one term is not intended to be exclusive of the other. For convenience, we refer mostly hereinafter to treatment of bundles of filaments, in view of the expected greater interest commercially in fibers, but films may also be treated according to the invention, as will be understood by those skilled in the art, or indeed any elongated drawable shaped article of undrawn or partially drawn polymer. By using the term "bundle" we do not imply that the several filaments are necessarily treated while bunched together, as it is often more convenient to treat the filaments as they are spread out in a band, whereby every filament is able to get essentially equal access to the treatment, as is conventional in treating a multiplicity of filaments in the art.

The expression "undrawn or partially drawn" was used by Guthrie, and is used by us in the same sense; for imbibition drawing to be effective, feed filaments, for example, should have portions that are sufficiently unoriented to permit imbibition of the desired additive to occur; this is why the feed (elongated shaped) article is referred to herein as "undrawn or partially drawn", as opposed to "fully drawn" articles that are not suitable feed articles for imbibition drawing.

The "additives" that are to be imbibed are discussed also by Guthrie and by Adams; flame retardants are mostly discussed hereinafter because of current commercial interest and lack of prior success in loading sufficient flame-retardants into polyester filaments, but similar techniques can be applied to incorporate other additives, as desired, for example to produce antistatic fibers and "superwhite" fibers. "cracking agent" used by Adams, and in the art. Guthrie was aware of Adams' teachings but avoided using term "cracking agent" and Guthrie mentioned "a liquid or vapor" containing an additive in solubilized, dispersed or emulsified form, being a non-solvent for Guthrie's fiber, and have a wetting angle less than 90° between the polymer of the fiber and his diluent. So we have correspondingly referred to "cracking fluids", to conform with Guthrie, while we feel most practical use will be with "cracking liquids". So, hereafter, we generally use the term "cracking liquid."

Any cracking agent used for the pretreatment may be different from the fluid used for the imbibition drawing, as, for instance, pointed out with respect to using water as the fluid for imbibition drawing. There may sometimes be advantages in using different liquids as will be apparent, especially, for example, when using water as the fluid for performing the imbibition drawing. It will often, however, be convenient to carry out the pretreatment in cracking liquid that has the same, or similar, composition as used for imbibition drawing. It may, for example, be convenient, and even advantageous in some circumstances, to carry out both pretreatment and imbibition drawing in the same bath of cracking agent, and providing additive, if desired, in that same bath.

An essential distinction from the prior art techniques for imbibition drawing is that the feed article (i.e., the undrawn or partly drawn elongated shaped article, such as one or more filaments or films) is first pretreated so that the imbibition drawing is performed on such a pretreated article. Pretreatment according to the invention provides imbibition drawing with significant advantages over prior imbibition drawing techniques, as will be related. Such advantages may vary according to the precise materials and techniques used, but may be summarized as providing an ability to infuse more additive, to infuse additive more uniformly, and/or to avoid (or minimize) causing the article to suffer a reduction of valued properties, especially reduced tensile values, which we had found to be a more or less inevitable result from imbibition drawing when carried out following the teachings specifically disclosed in the art. The improvements and advantages that we have found to be attainable according to the invention have changed imbibition drawing from an interesting laboratory technique, that had been disclosed in the 1960's and 1970's without having been adapted commercially, into a practical manufacturing technique adapted for commercial practice in the 1990's.

Pretreatment according to the invention preferably involves straining the feed article while wetted with cracking liquid. Such straining preferably involves rapid deformation (while the feed article is so wetted). One type of rapid deformation may be achieved by passing the (wetted) feed article over an edge, such as a "knife edge". This technique is somewhat similar to edge crimping (but the feed article should be wetted with cracking fluid while being subjected to deformation) and has been found to produce microcracks that have been found to develop into crazes during the later imbibition drawing. Further details of this "knife edge" technique are related hereinafter.

Preferably, however, the straining pretreatment according to the invention involves tensioning the feed article at a carefully selected low tension which is sufficient to effect partial drawing of the feed article (which is wetted with cracking liquid). When this preferred partial drawing straining pretreatment is performed, we have found it possible to carry out the imbibition drawing in water, which can have obvious advantages in appropriate circumstances; in other words, when this preferred partial drawing straining pretreatment is performed, although the feed article is wetted with cracking liquid during this pretreatment, provision of additional cracking liquid (as the fluid containing the additive) has not been needed during imbibition drawing. Development of crazes continues, with imbibition of additive, in the presence of the water, to produce concentrations of additive in the resulting drawn article that are comparable to those we have obtained by imbibition drawing in a bath of cracking agent. However the presence of such cracking agent during the actual imbibition drawing gives excellent results, according to the invention, and such cracking agent may be the same as used during pretreatment, or different, as mentioned already.

Thus this preferred process of the invention is characterized by a pre-(imbibition drawing) treatment which preferably consists essentially of wetting undrawn or partially drawn fibers (or film) with a cracking agent and straining the fiber bundle (or film) under a low tension. The straining may conveniently be effected simultaneously with the wetting, but can be effected subsequently, while the article is still wetted, prior to imbibition drawing, and some advantage may sometimes be obtained by maintaining tension on the strained article for a short time interval prior to drawing.

We shall now discuss in more detail this preferred pretreatment that involves straining the article, especially by carefully stretching under certain conditions.

Clearly, any drawing that takes place during pretreatment should be only partial, to allow for later imbibition drawing, i.e., to allow infusion of additive during later further drawing.

Draw ratios have conventionally been carefully controlled by passing filaments, for example, first between at least one pair or set of feed rolls, and then between at least another pair or set of draw rolls, both sets of rolls being driven at controlled speeds, and the draw rolls being driven at a controlled speed that is higher than the controlled speed of the feed rolls, such that the draw ratio is the ratio of the speeds of the two sets of rolls. Thus a draw ratio of 2X corresponds to stretching the filaments 100% by running draw rolls at twice (2X DR) the speed of the feed rolls. It is generally desirable to stretch the filaments less than 100% during this type of pretreatment according to the invention, preferably less than 50% (1.5X DR). A low partial draw ratio of 1.05X has given good results, and we expect even lower draw ratios, such as 1.01X, will also be operable, and generally at least 1.02X according to this preferred pretreatment embodiment of the invention.

Figure 5:
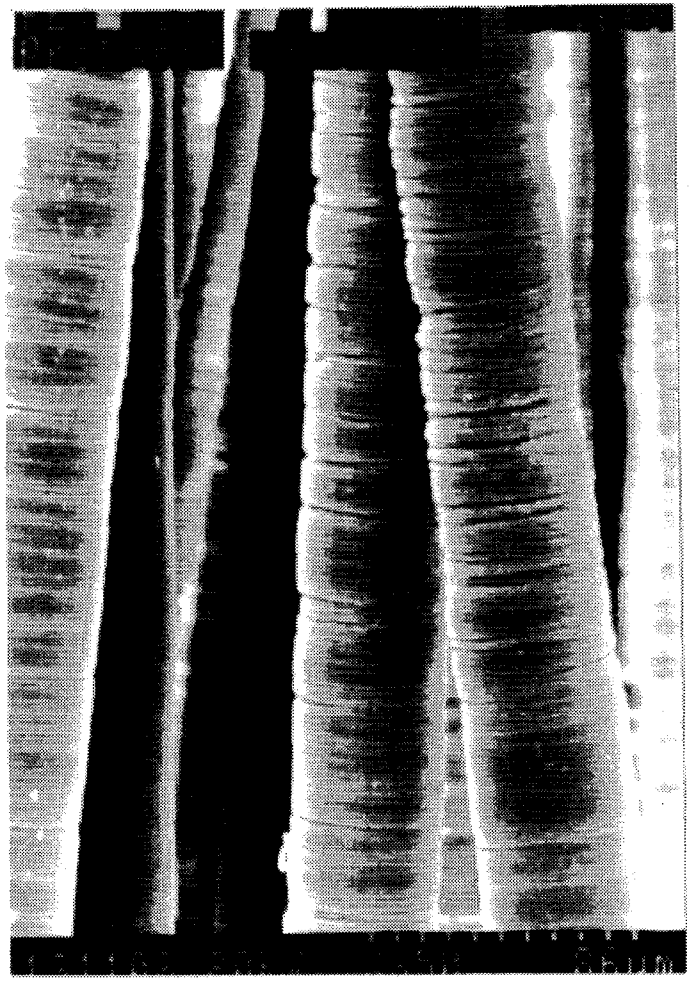
Figure 8:
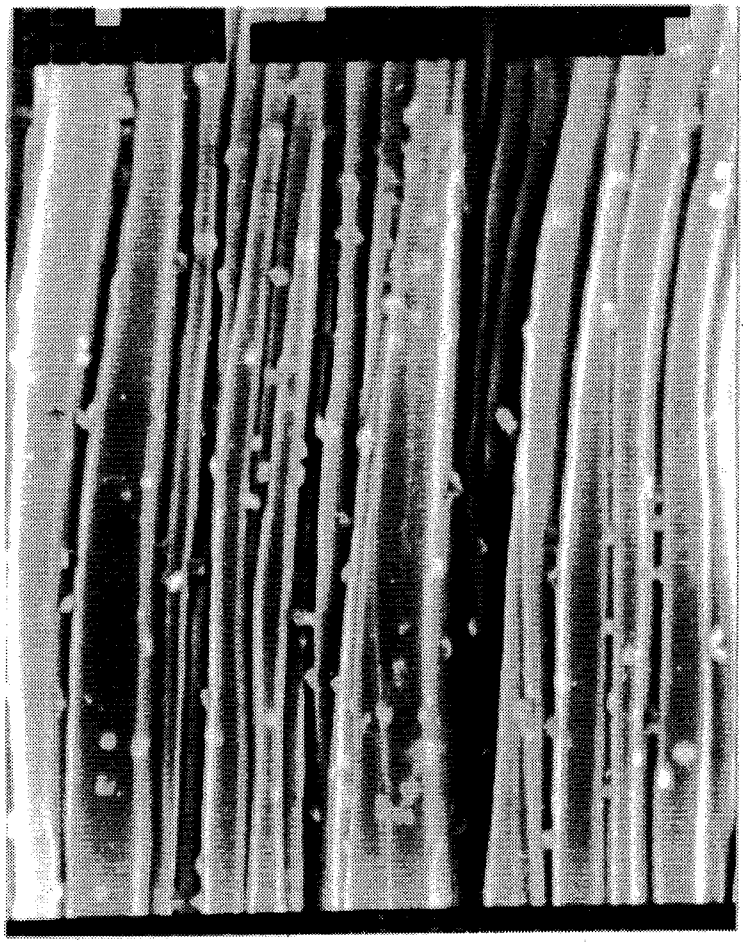
Figure 7:
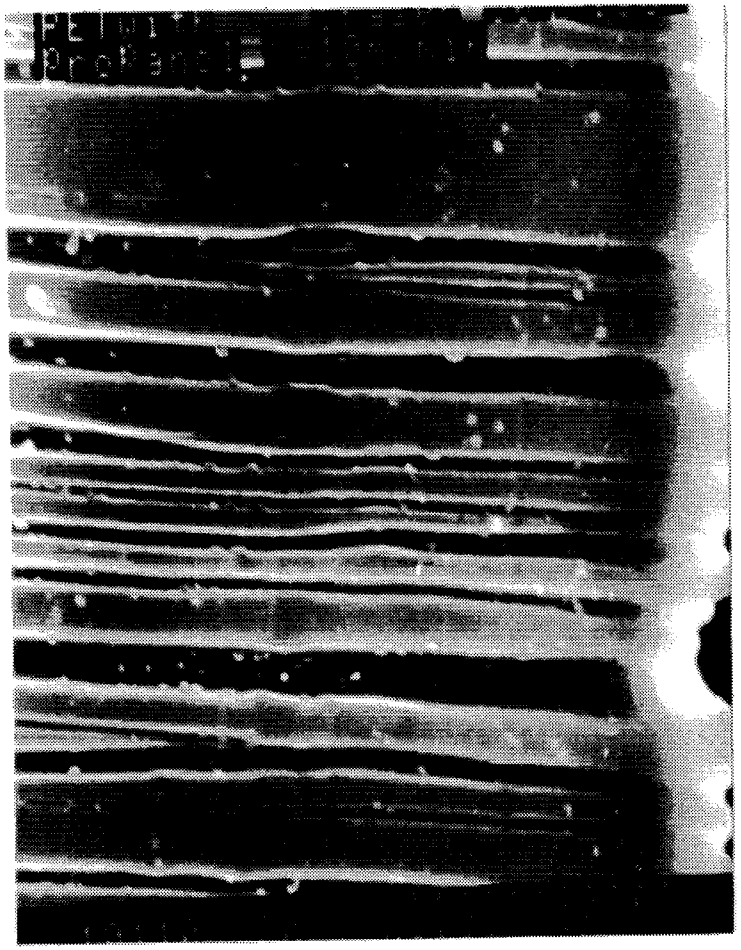
Figure 14:
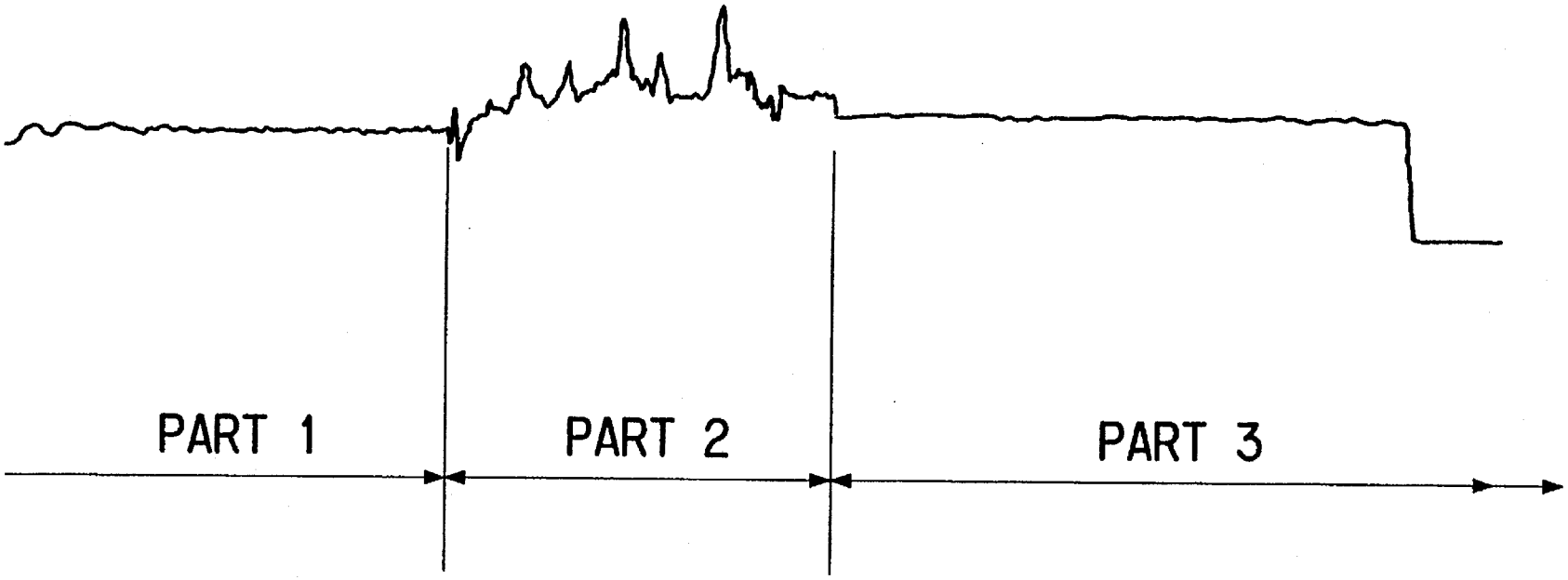
FIG. 14 is a tensograph with three parts, as discussed hereinafter.
Figure 15:
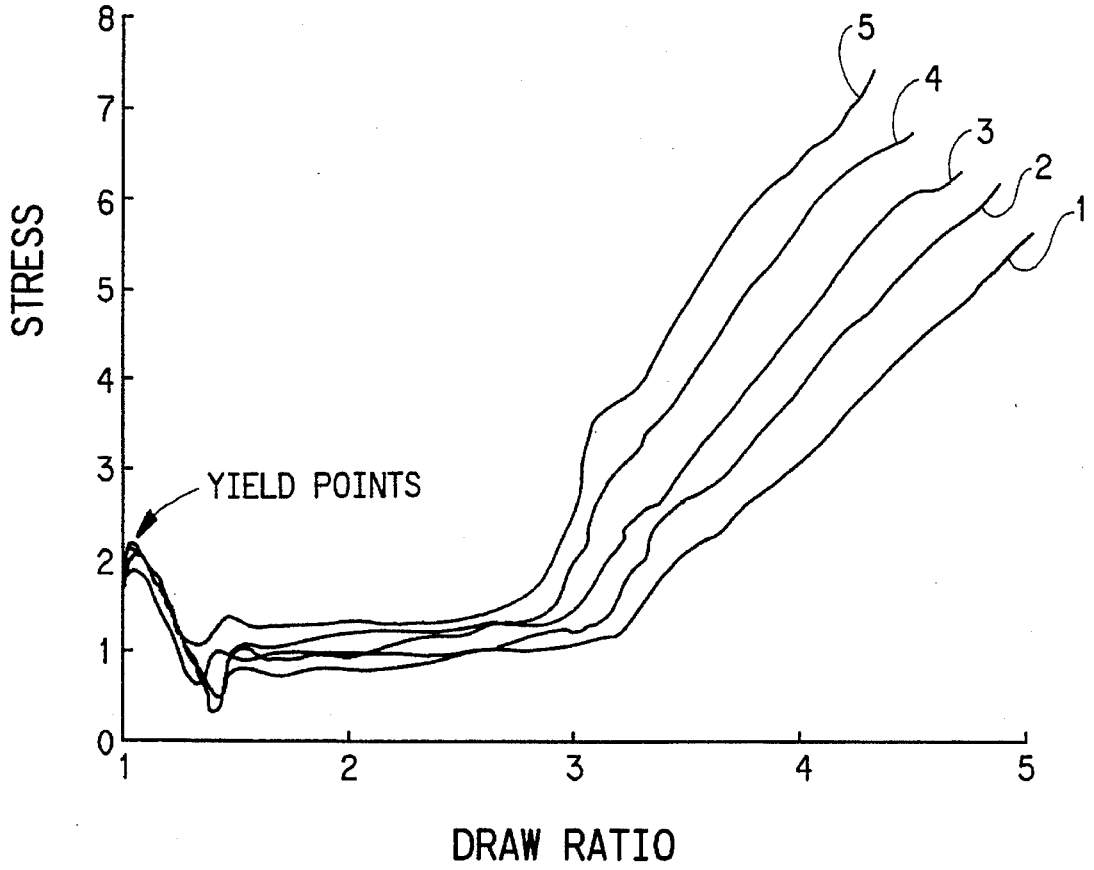
FIGS. 15 & 16 are stress-strain curves, as explained hereinafter.
Figure 16:
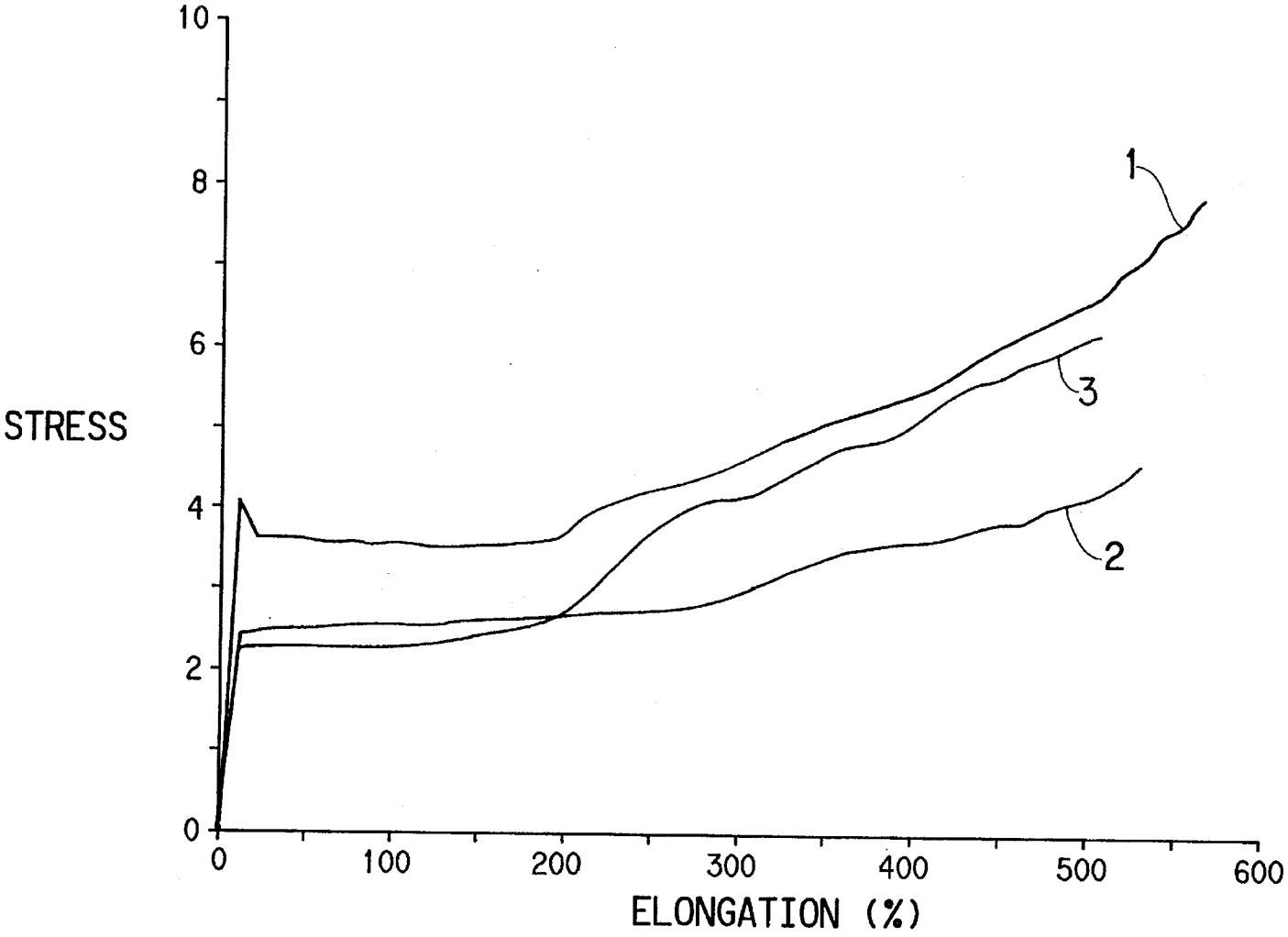

The pretreating stress applied to the wetted article (e.g., filaments) will be less than the stress at the yield point of the filaments in air, such as may be determined conventionally from a stress-strain curve on an Instron machine, such as shown in accompanying FIG. 15, which is FIG. 5.27 on page 175 of "Polyester Fibres", by H. Ludewig, 1971, John Wiley and Sons Ltd. As can be seen in Ludewig's book the 5 curves correspond to 5 doting speeds (460, 700, 850, 1000 and 1150 m/min for curves numbered 1 to 5, respectively). FIG. 15 shows the stress rising quickly each time up to yield points which are indicated by the arrow near the "y" axis, and which are the peak tensions, and then the stress falls below such peak tensions, before more or less levelling off. The stress needed to draw similar filaments wetted with cracking liquid (at the same temperature) is significantly less than the stress required to draw in air (or in water, which is very convenient in practice, as will be explained). This is shown in FIG. 16, which shows three stress-strain Instron curves. In FIG. 16, we have plotted stress vs elongation, whereas Ludewig plotted stress vs draw ratio. Each curve in FIG. 16 is for (a different sample of) the same polyester yarn spun at 800 m/min, drawn under the same conditions, except curve 1 shows what happened when drawing was performed in air, whereas curves 2 and 3 show results of drawing in different cracking liquids, curve 2 being for isopropanol and curve 3 for a butanol/water mixture. This makes possible drawing such wetted filaments (wetted with cracking agent) at a stress less than at the yield point in air (or water). In order to so draw the wetted article, the stress applied should be sufficiently high to effect the drawing that is desired for pretreating straining, but should not be so high as to fully draw the (wetted) article. Thus, considering FIG. 16, it is desirable for the pretreating conditions not to be towards the right parts of curves 2 or 3, but to be close to the yield points, i.e., on the flatter portions of these curves towards the left, where each curve flattens out after rising steeply towards the angle, which is the yield point, and may sometimes be a peak. Nor should the drawing desirably be unstable. In practice, preferred pretreating conditions for improving crazing performance according to the invention can be identified by absence of oscillations (i.e., the partial drawing should be essentially vibrationless during the pretreatment), as shown in FIG. 14, discussed hereinafter.

We have found that the effectiveness of this preferred pretreatment straining according to the invention can be indirectly assessed by measuring filament bundle tension, either after the crazer or in the imbibition step. We found that polyamide and polyester behaved similarly in this respect, in their respective cracking liquids. Such measurements can be used to set up machine parameters for effective crazing, by controlling the draw tension and avoiding bundle oscillations in the imbibition zone or between the crazer and the imbibition zone. When the bundle is properly wet with the cracking liquid and pretreatment is optimal the tension is very stable and the curve is essentially flat. The tension needed for imbibition drawing is lower than if the imbibition drawing were performed in the same cracking liquid without the pretreatment. Oscillations of the tension, causing bundle vibrations, indicate a mix of necking and crazing and are undesirable, while a pure crazing with a high density of crazes per mm length, as desired, proceeds with a very smooth and regular tension. This is illustrated in FIG. 14.

Figure 11:
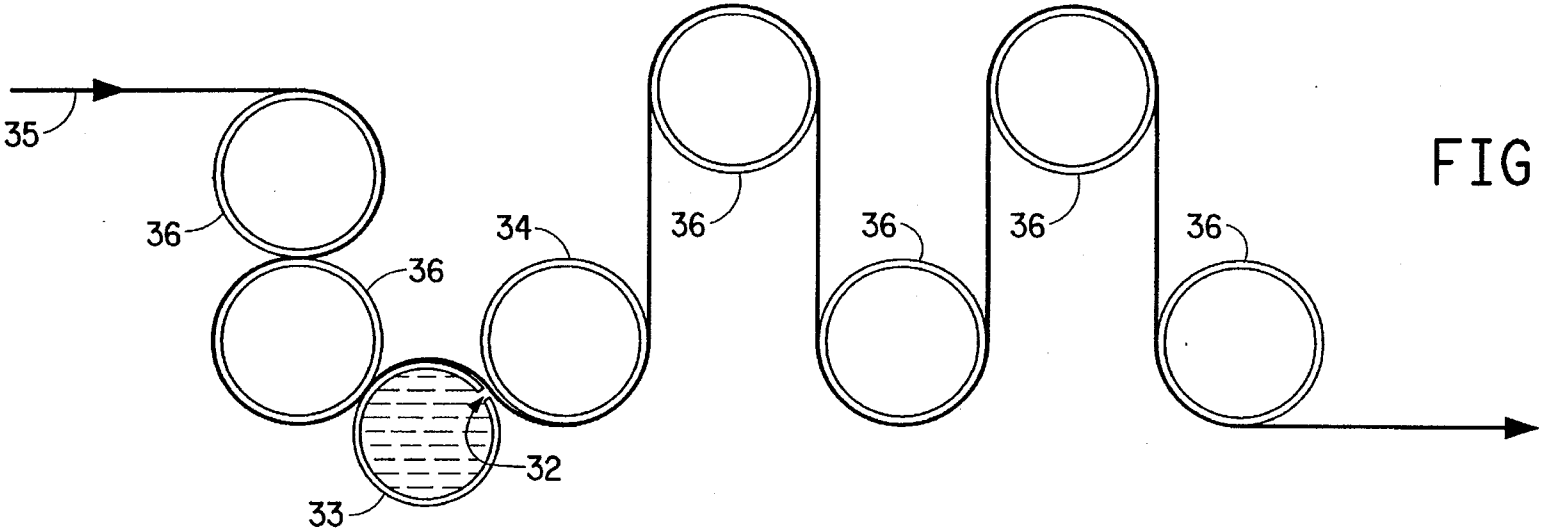

Part 1 in FIG. 14 shows variations in the tension on a bundle of polyester fibers measured in the imbibition zone, where the draw ratio was 1.9X, after pretreatment according to the invention by pre-drawing to 30%, using apparatus as illustrated in FIG. 11. The same cracking liquid was used for both pretreatment and for imbibition (93/7 water/butanol). As can be seen, this part is relatively flat, showing little variation in tension, as desired. Part 2 plots the tension when drawing the same bundle 1.9X in the same mixture of water/butanol 93/7, but after 30% pre-drawing in air (instead of pretreating in cracking liquid according to the invention). It shows a very irregular tension with high tension picks and an unstable process. Part 3 shows drawing in the same mixture of water/butanol 93/7 to a draw ratio of 1.9X, without any pretreatment drawing at all. This Part 3 was also smooth, without oscillations, with the draw tension being higher than in Part 1. The higher draw tension required in Part 3 reflects the different number and types of crazes that were created by processes of the prior art, when no pretreatment was done before imbibition drawing. The amount and type of crazing without pretreatment was, however, enough for the drawing to proceed according to the imbibition drawing mode rather than the necking mode. From the second part of the tensogram of FIG. 14, it is evident that drawing proceeded via a mix of necking and imbibition drawing, due to the 30% pre-drawing being in air, instead of in cracking liquid.

Because the stress needed to draw the feed article when wetted with cracking liquid is less than required in air, or in water, it may be very convenient to localize the draw point for pretreatment straining purposes by subjecting the feed article to a desired tension, e.g., between sets of feed and draw rolls as described, and by wetting the feed article with cracking agent only at the location desired so as to effect pretreatment by straining (while wetted with cracking agent) at that restricted location, and preferably avoid wetting the feed article with cracking agent elsewhere, i.e., other than at the desired pretreating partial drawing location, e.g., protecting (shielding) the feed article from being splashed by cracking fluid except where desired. Thus application of the cracking agent may be limited to a narrow band close to a draw roll, and preferably just before such draw roll. This may be achieved by applying cracking agent through a narrow slot in a fixed roll, or by spray nozzles, or by a metering device, e.g., as used to apply finish to fleshly-spun filaments, or between pins or in other manner known to those skilled in the art. A similar set up may be used, if desired, for the later imbibition drawing, in which case additives should be made available for infusion into the article.

We have been surprised to find that use of our preferred straining pretreatment has made imbibition drawing possible in water, i.e., without supplying more cracking agent in the bath used for the actual imbibition drawing. We believe that the fact that the actual imbibition drawing may be performed in a bath of another fluid such as water (and of the additive), rather than in a bath of cracking agent as taught by Adams and Guthrie, is because of the improved results brought about by pretreating the feed article according to the invention. This ability to perform the imbibition drawing in water (rather than in cracking fluid) is obviously of advantage from environmental and commercial standpoints.

The objective of the pretreatment according to the invention is to improve the later imbibition drawing, as contrasted with any imbibition drawing techniques specifically taught by Adams or Guthrie, which latter did not disclose any pretreatment (in contrast to the present invention). We believe that pretreatment according to the invention improves the quality of crazing in the article before or during imbibition drawing, and the quality of the resulting fine structure in the final drawn article (after imbibition drawing and any subsequent drawing) and the distribution of the finely divided additive in the fine structure of the final drawn article. It may sometimes be possible to examine an intermediate pretreated article to determine the nature and extent of crazing, depending on the process technique used. But, depending on the process technique, it may be inconvenient to interrupt some processes according to the invention to examine the article at an intermediate stage. However a comparison of a final drawn article that has undergone imbibition drawing following a procedure specifically taught by Adams or Guthrie with a final drawn article that has been similarly processed except for having been pretreated according to the invention should reveal an improvement in the article processed according to the invention. Such improvement may be in the quantity of additive imbibed, and/or the uniformity of distribution of the additive imbibed, and/or the properties (especially tensile properties) of the article. Similarly, when it is possible to make comparisons of the quality of crazing in an intermediate crazed article, we have found that there has been an improvement in the quantity and uniformity of crazing in intermediate crazed articles that have been pretreated according to the invention, for instance the linear density (number of crazes per unit length) and/or evenness of depth of crazing, as contrasted with crazing in articles processed following a procedure taught by Adams or Guthrie.

Because we believe the improvements brought about by the invention result from improved crazing brought about by pretreatment according to the invention, we sometimes refer herein to an apparatus used for pretreating straining as a "crazer". Examples of suitable crazer apparatus are illustrated in FIGS. 9–13 hereinafter, and other modifications will be possible to those skilled in the art.

As indicated earlier, another technique for achieving pretreating straining is to use a "knife edge." Such a crazer is somewhat similar to what has been used for "edge crimping." The combination of applying mechanical strain by deforming the article rapidly over the edge and wetting the article with cracking agent during this type of "edge" pretreatment according to the invention is believed to initiate a multitude of microcracks on the surface of the fibers. During imbibition drawing, microcracks develop into full crazes which extend across the whole thickness of the film or filament. They can easily be observed under an optical microscope using relatively low draw ratios of about 2X. Such pre-treatment has not only increased the number of crazes by 5–10X or more, as compared with imbibition drawing without such pretreatment, but has also controlled the regularity of their spacing and thus has avoided or reduced the number of weak points in the fiber or film and has controlled the size of the inclusions of drawing liquid and the chemicals it contains. The "knife edge" selected for use in this type of pre-draw treatment according to the invention can have a large impact on the frequency of micro-cracks formed in the process, and is preferably of metal, such as metal wire, a rounded cuing knife or folded thin metal plate, preferably of stainless steel, but can be made of ceramic or other materials having an appropriate cross section. The fibers can be passed over one or several of these edges which can either be on the same side of the filament bundle or preferably on both sides, effectively. A stainless steel rounded cutting knife is generally preferred for practical reasons, as it is easily available and mountable, and the diameter of the edge can be reworked with precision tools after wear. A folded stainless steel plate has also given good results. Use of a wire can provide advantage in some circumstances, for instance to permit control of the deformation angle by changing the diameter of the wire, and a wire can also be replaced easily at low cost when it shows some wear. To reduce the wear of the crazer, it may be coated by chromium or another hard wearing coating known in the art. The optimum diameter of the crazer and the desirable friction characteristics of its surface generally depend on the speed of the article, and on the cracking agent selected.

The higher the speed, the more mechanical deformation is generally required to achieve the desired results, so a smaller diameter is generally desirable.

At speeds of 100–200 m/min, we have found a wire with a diameter of 2 mm to be satisfactory, but at speeds of above 800 m/min, we have preferred to use an edge crazer with a diameter of 1 mm or less, and 0.5 mm was the diameter used in some of our Examples. A range of 0.1 to 2 mm for the diameter will generally be preferred, and it is expected that a practical maximum for the diameter may be somewhere below 10 mm.

Using two "knife edges", one on each side of the bundle, has produced results which have been particularly favorable, more so than could have been expected from just adding a second edge treatment on the same side of the bundle. We believe that bending the filaments in opposite directions within a very short time provokes the formation of more microcracks than the simple additive effect of two crazers on the same side.

Figure 9:
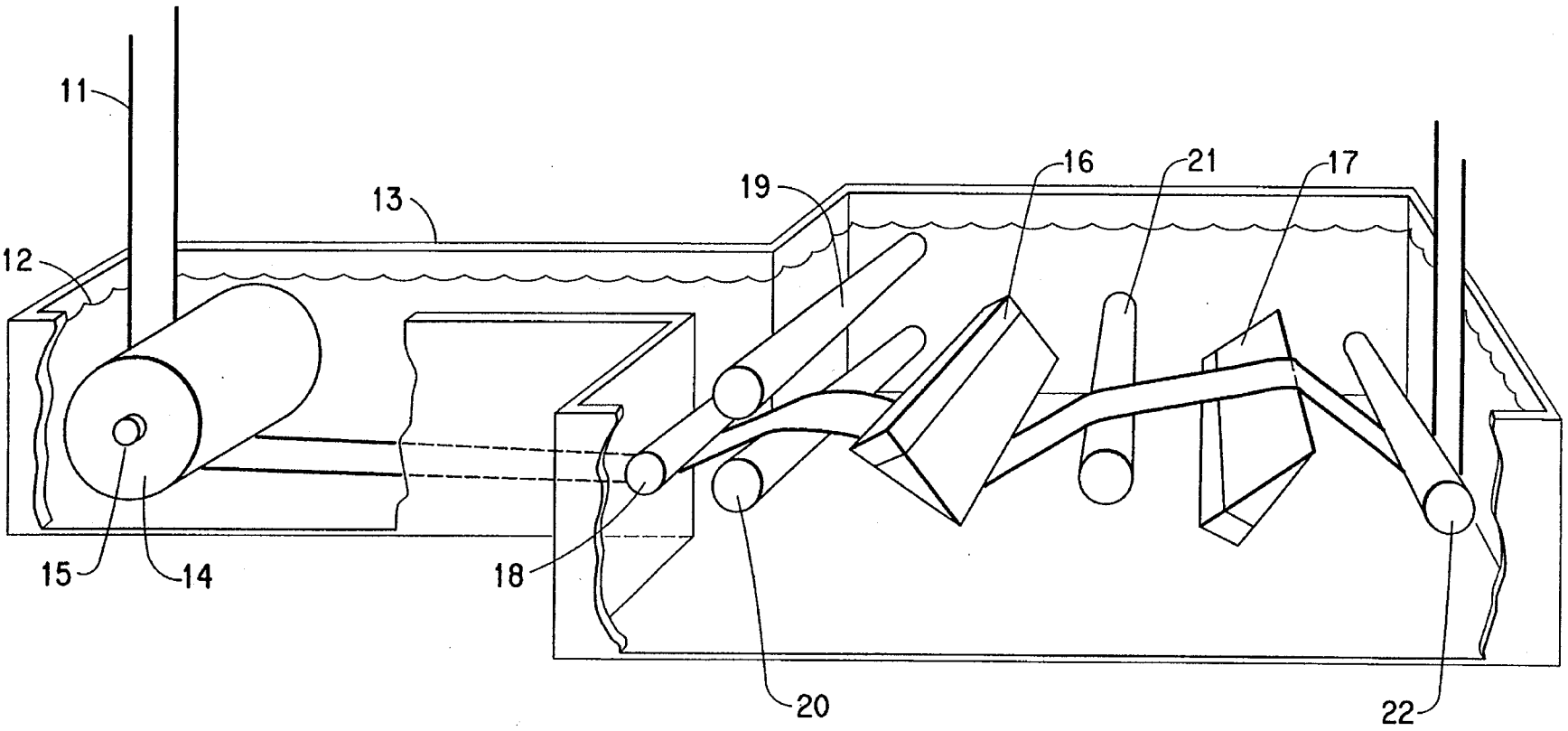
FIGS. 9–13 are schematic representations of apparatus for performing representative processes of aspects of the invention, as discussed hereinafter in more detail.

A preferred type of apparatus with two knife edges for performing a process according to the invention is described with reference to FIG. 9, which shows schematically in partly cut away section a perspective view of such an apparatus. Referring to FIG. 9, a sheet 11 of undrawn filaments is led through cracking liquid 12 contained in a bath 13, under a guide roll 14, that is rotatable about its axial shaft 15 and that is below the surface of liquid 12, towards first and second knife edge crazers shown generally as 16 and 17, respectively. The sheet 11 of filaments is spread out to form a single layer of filaments, similar to a weftless warp sheet, so each filament will be in contact with guide roll 14, with the crazers 16 and 17, and with other guides 18–22 that are under the surface of bath 13.

As shown in FIG. 9, sheet 11 is guided between guides 18–20 and first under first crazer 16, then over guide 21 and over second crazer 17 and under guide 22 before passing up out of bath 13 and liquid 12 to a next stage, generally imbibition drawing. By such means, each filament in sheet 11 undergoes the same two quick changes in directions as it contacts first crazer 16 and then second crazer 17, while each filament is strained under a low tension, which tension and angles of bending are controlled by adjusting the speed by which sheet 11 is advanced, and the relative positions of guides 18–22 and crazers 16 and 17, and also the angles of the crazers in relation to the direction in which sheet 11 is forwarded. As can be seen, crazers 16 and 17 contact opposite sides of the filaments (and opposite sides of sheet 11).

Figure 4:
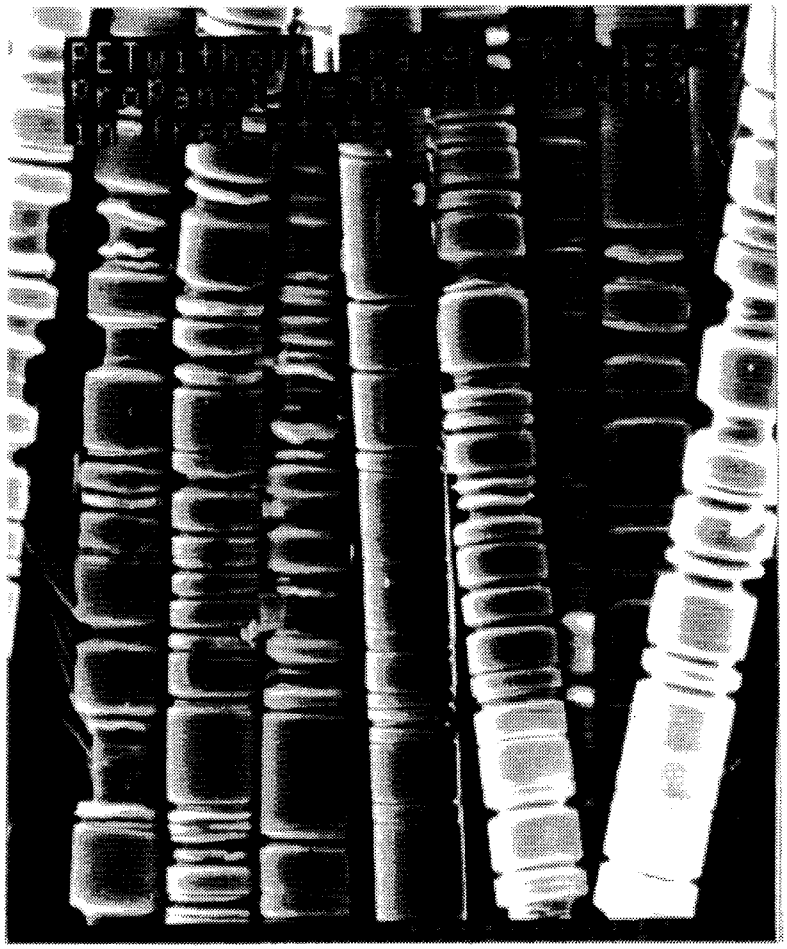
Figure 3:
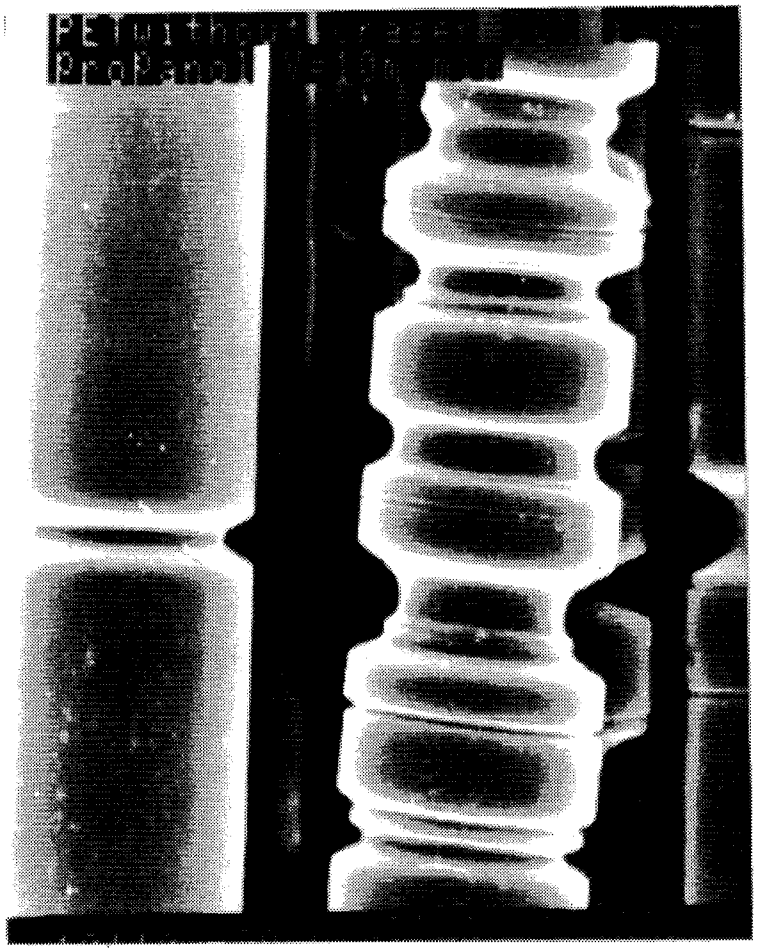
Figure 6:
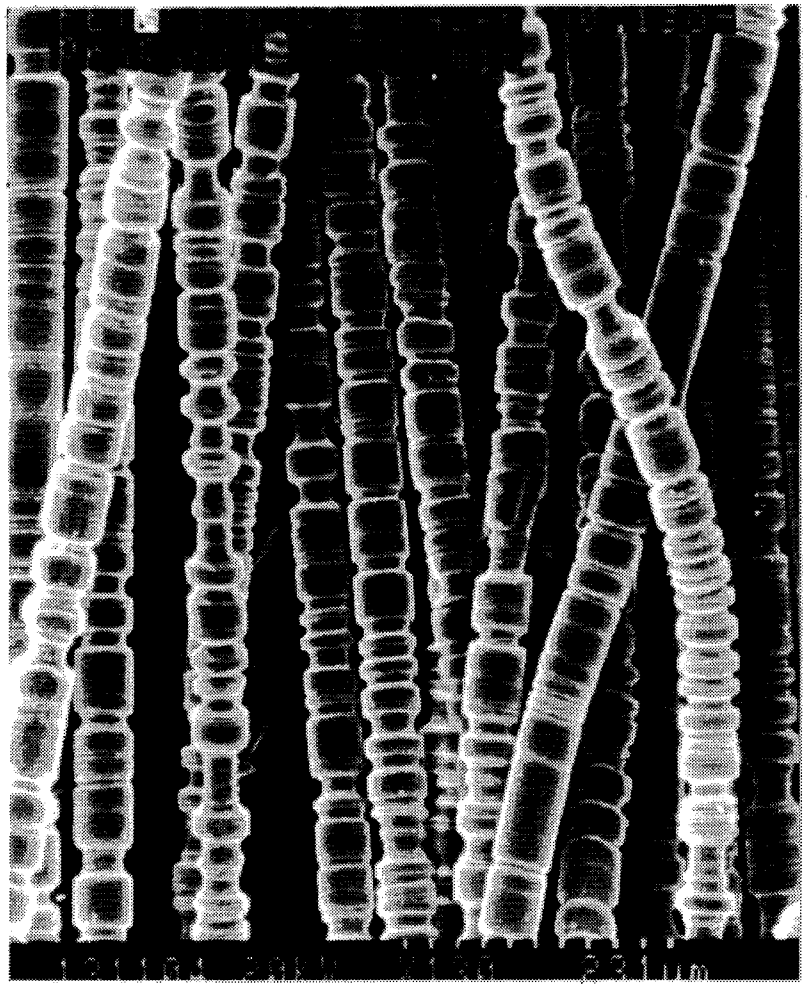

Differences in the structure of polyester fibers are clearly illustrated in the SEM photographs of FIGS. 1 to 8. All the fibers were drawn in one stage to 50% (1.5X) under the same conditions in a cracking agent (isopropanol), except that those shown in FIGS. 1, 2, 5, 7 and 8 had been pretreated according to the invention by being pretreated with a knife-edge crazer before being drawn 1.5X, whereas those shown in FIGS. 3, 4 and 6 were drawn 1.5X in isopropanol without such pretreatment. The photographs show treated filaments from a standard feed stock spun at 800 m/min to a dpf of about 7.3 dtex, after single stage drawing 50% (1.5X) in isopropanol (as the cracking agent) at 10 m/min and 70 m/min. FIGS. 3, 4 and 6 show filaments drawn in isopropanol without use of a crazer (i.e., drawn in isopropanol essentially as taught by Adams). FIGS. 1, 2, 5, 7 and 8 show filaments similarly drawn in isopropanol, but after pretreatment with a knife edge crazer in isopropanol according to the invention, using apparatus essentially as illustrated in FIG. 9. Details are listed on the photographs.

Using procedures of drawing in isopropanol without pretreatment on a crazer (FIGS. 3, 4 and 6) we have observed that:

- The distribution of necks per unit length of fiber is very irregular and the number (2–26/mm) is not high at 10 m/min.
- Increasing the strain rate (from 10 m/rain to 70 m/rain) increased the number of necks to 20–80/mm, but otherwise gave similar problems.
- The necks have tended to collapse into fully drawn sections with a closed structure that loses porosity so cannot take in more cracking agent and additive.
- Under low magnification, these filaments appear as a series of cylinders connected by much narrower sections.
- Overall the results are somewhat similar to those obtained by true neck drawing, as known from the literature.
- Several fibers show deep cracks or severe deformations in the drawn collapsed sections. These explain the poor mechanical properties and the broken filaments obtained by this technique of the prior art.
- In the tested range the number of necks depends on draw speed.

In contrast, in FIGS. 1, 2, 5, 7 and 8, using a drawing procedure in isopropanol according to the invention, after pretreatment in isopropanol with a knife-edge crazer, one can observe an entirely different structure vs those in FIGS. 3, 4, and 6:

- The fibers have many times more cracks.
- The fibers have a uniform distribution of crazes (and their number did not seem to depend much on draw speed, at least within this range).
- The fibers are very uniformly drawn and do not show (at this stage of the drawing) collapsed fiber sections; indeed, at low magnifications, the surfaces seem almost smooth; at higher magnifications, one realizes the surfaces are not smooth but have a very high density (number) of crazes.

The preferred technique of pretreatment straining, whereby initiation of the crazes is achieved by a localized partial drawing of the fiber, while wetted with cracking agent, can be carried out in many different ways, some of which are illustrated in FIGS. 10 to 13, by way of examples of embodiments of the invention without any limitation of the invention, but merely to illustrate the principle of this technique.

Figure 10:
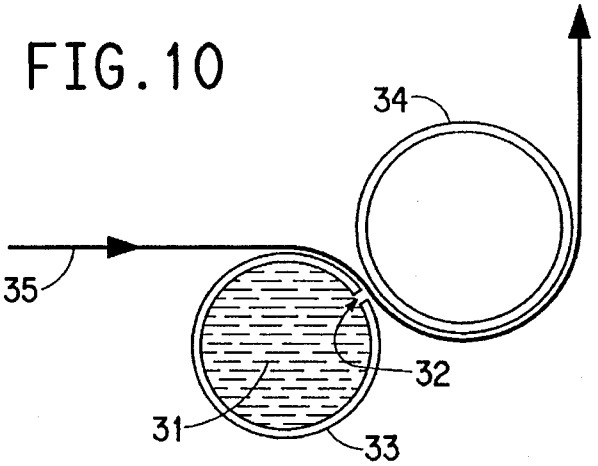

FIG. 10 illustrates an application of cracking liquid 31 through a slot 32 in a stationary cylindrical reservoir 33 which is placed in immediate proximity to a first draw roll 34, which is driven. The filament bundle 35 is bent over the stationary reservoir 33 before passing toward the first draw roll 34.

FIG. 11 illustrates how the crazer in FIG. 10 can be incorporated into a continuous drawing line. This set up is very similar to one used in Example 5. Filament bundle 35 passes round feed rolls 36 (only two are represented here, but in practice four or more will generally be used to avoid slippage), then onto stationary cylindrical reservoir 33 with the application slot 32, as illustrated in FIG. 10, before passing around the first draw roll 34 and further draw rolls 36 which are driven at the same speed as 34.

Figure 12:
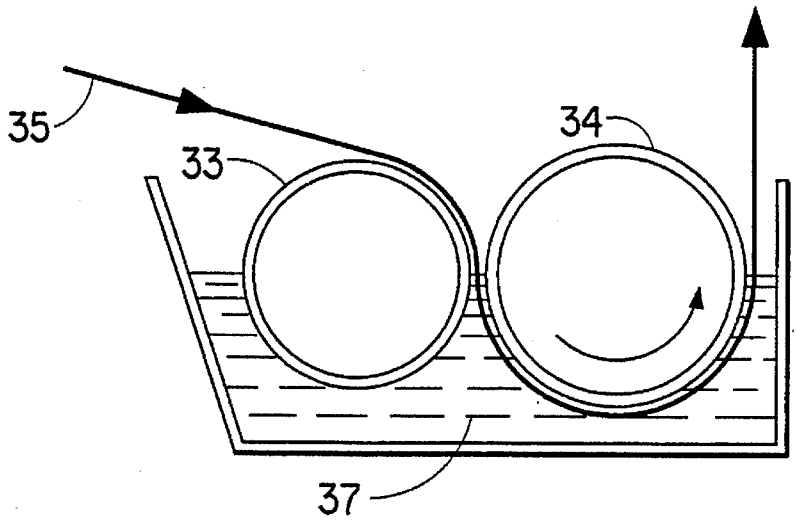
Figure 13:
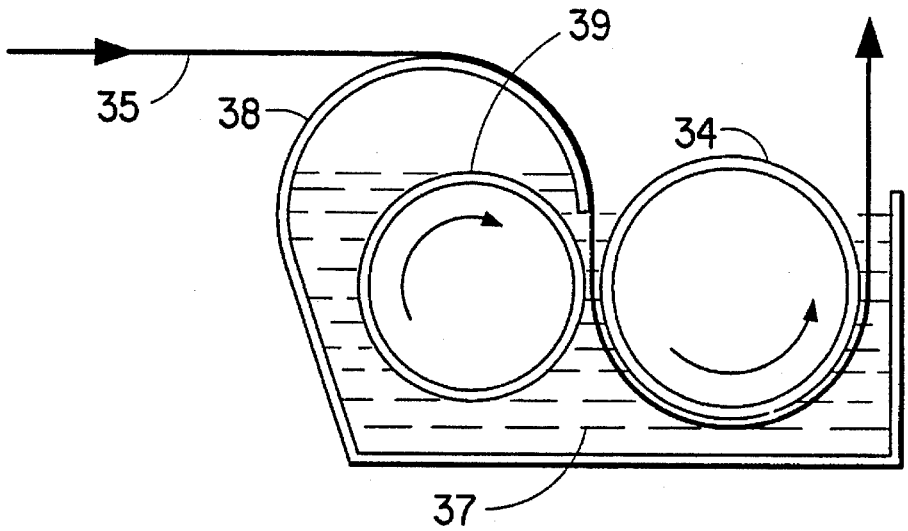

FIGS. 12 and 13 illustrate two other possible pre-draw crazers based on localized drawing prior to the imbibition drawing step. Both designs show the pre-draw treatment in a bath of cracking liquid, instead of applying the cracking liquid through a slot in a stationary roll, as in FIG. 10.

In FIG. 12 the bundle 35 is bent over a stationary cylindrical guide 33 and then passed around the first draw roll 34. The lower halves of guide 33 and roll 34 are embedded in a bath 37 of cracking liquid. The crazing takes place as part of the bundle is immersed in the liquid.

FIG. 13 illustrates another variant of the possible crazer construction whereby the bundle 35 is bent on a rounded shape 38, then passed under first draw roll 34, while a pinch roll 39 ensures there is no slippage and helps to localize the draw point by engaging the filament bundle in the rip between pinch roll 39 and draw roll 34. The pinch roll 39 and lower part of the draw roll 34 are embedded in the cracking liquid bath 37.

Any drawing in the pretreatment stage should be sufficient to initiate the desirable cracks or crazing, but the shaped article should preferably not be drawn during pretreatment straining more than required for this purpose, because unnecessary drawing will reduce the amount of additive which can be infused into the fiber during imbibition drawing. In practice, we have found that a pre-drawing of 1–100%, preferably 5–50%, in the crazing stage is a good compromise between the effectiveness of the crazing and the capacity to imbibe additive, while it will be recognized that the range of draw ratios will depend on feed yarn orientation.

According to one aspect of the invention, fibers which have been submitted to our pre-treatment have been drawn in a cracking liquid containing the additive to 100–250%, followed by one or more drawing steps in the same liquid or in another liquid or in air. Drawing in the cracking liquid has propagated microcracks initiated in the pre-treatment, allowing the liquid and additives dissolved or emulsified therein to fill micropores which have been formed, and to become uniformly distributed in the fibers.

According to another aspect of the invention, fibers which have been submitted to partial drawing pretreatment have been drawn in an aqueous medium containing the additive without any cracking agent. This clearly demonstrates the effectiveness of pretreating according to the invention, as contrasted with Adams and Guthrie. It has been well known that conventional drawing of polyester in water has not produced crazing but conventional neck drawing. The advantages of such a process from the environmental and manufacturing cost point of view is evident. Little cracking liquid infuses into the fibers at such low draw ratios, and any carry over from the pre-treatment (crazing) bath into the imbibition drawing bath is usually small, most of the cracking liquid being usually infused during drawing. Virtual absence of organic solvent from the imbibition bath reduces dramatically the amount which needs to be recovered and makes control of undesired emissions much simpler and easier.

In still another aspect of the invention, additive has been applied at the same time as the cracking liquid prior to pretreatment straining (with or without partial drawing) before imbibition drawing.

The application of the cracking agent and the additive in any process can be by spraying, by dipping or by a finish roll or any other method.

It is possible to perform the controlled pretreatment straining immediately after spinning or several weeks later without essentially changing the process techniques, although some adjustment of the concentration of the additive in the liquid and of draw ratios may be required to keep the final concentration in the fiber and mechanical properties of the fibers within desired control limits.

A preferred method consists of pre-treatment straining prior to imbibition drawing, with or without additive in the cracking liquid, followed by drawing in a bath containing a solution or dispersion of the additive in a liquid, which may be a cracking agent, but preferably in water. After the pretreatment (including any first drawing step) has been completed, the fibers are further drawn in one or more steps which may be in air, in water, in steam, or in another liquid, such as the cracking agent, to complete the drawing. Preferred drawing media for the second and optionally further drawing step(s) are hot water and steam, to improve the mechanical properties of the drawn fibers.

After completion of the drawing, the fibers can, if so desired, be washed to remove any excess of the chemicals on the surface, and crimped and heated if desired. The cracking liquid and/or water can be driven out (and recovered, if desired) prior to or during relaxation crimping or other further processing.

The polymeric materials which can be treated by this process include polyesters, such as polyethylene terephthalate, polyamides, polypropylene, polyethylene, and other undrawn or partially drawn melt-spun polymers, especially those which are drawable to form crystalline polymers.

Polyester, polypropylene and polyethylene have shown similar behavior with respect to the crazing conditions and generally it is believed possible to carry the imbibition process on these three polymers under similar conditions, using essentially the same cracking liquids and crazers.

Polyamides are different because of their strong interaction with water and the resultant effect on the glass transition temeprature ($T_g$). Consequently the effectiveness of cracking agents on polyamide depends both on the water content of the polyamide fiber or film, and on the water content of the cracking agent. Generally speaking, polyamide 6 or 6.6 fibers or films conditioned at 65% RH or lower humidities may be crazed in a wide range of organic liquids at room temperature, but, with increasing RH% towards 100%, the crazing mode of deformation is lost. In general we have found that alcohols or ketone alcohols such as propanol, t-butanol or diacetone alcohol can be effective crazing agents for common polyamides. However, if aqueous solutions are to be used, then they have to be cooled to below room temperature, whereas such aqueous solutions have been very effective cracking agents at room temperature for polyesters and polyolefins. Alternatively aqueous solutions of some metal halides may be used at room temperature.

Many cracking agents have been suggested in the prior art, e.g., by Adams, Guthrie and in other published literature. Selection of the cracking agent and the drawing media depends on the polymer used, as mentioned already. We do not know any rule which allows one to predict whether a given liquid will be an effective crack drawing media for any given polymer. In principle, the cracking agent should be a liquid which is only a little aggressive for the fiber, and is not a swelling agent. It is believed a true imbibition drawing takes place only at temperatures which are significantly lower than the $T_g$ of the polymer. It has also been suggested that there is a relation between the wetting angle of a potential cracking agent and its effectiveness as a cracking agent, lower angles being more effective as cracking agents. We have found this to be correct for the alkanol cracking agents and their mixtures with water.

We have found that adding small amounts of wetting agents, such as $C_6$–$C_{10}$ alkyl sodium sulfonates, to the cracking liquid in the crazer has had a significant impact on the amount of additive imbibed, particularly when the drawing has been in water. Concentrations of 1–10% of wetting agent are usually sufficient. Using aqueous solutions of dyes in the imbibition step, we have achieved distinctly deeper colors by adding 1% $C_8$-alkyl sodium sulfonate to a saturated solution of n-butanol in water in the crazer.

Because of practical reasons, e.g., balancing effectiveness as a cracking agent versus odor and toxicity, and bearing in mind what has been said about the special nature and problems with polyamides, alcohols and their mixtures with water have been preferred agents; such as ethanol, ethanol/water, propanol, propanol/water, isopropanol n-butanol, n-butanol/water or similar mixtures. Other products such as pyridine/water were reported in the prior art.

Preferred cracking agents are not only effective but have low toxicity and a relatively high flash point. Cracking agents which have a flash point which is higher than 30° C. can be used in installations which are not spark-protected and do not have to be surrounded by anti-explosions walls. The higher the flash point, generally the higher the safety margin. On the other hand, it would generally be undesirable to have cracking agents with too high a boiling point, because this would make it difficult to drive the cracking agent out during drying. The preferred cracking system has a relatively high flash point, but a boiling point which is not higher than 130°–170° C., so that it can be dried easily in a relaxer oven. Preferred cracking liquids, from both environmental and process simplicity point of view, are water-based, beating in mind what has been said about polyamides. The use of aqueous systems reduces the investment which would otherwise be required, e.g., to provide a solvent recovery system and explosion-proof walls. Solutions of n-butanol in water, with or without addition of alkyl sulfonates or other wetting agents, have been found to produce excellent results under commercial processing conditions, and to be superior to well known solvents suggested in the prior art, such as isopropanol, or n-propanol, and have an advantage of being able to contain 86% by weight or more of water and therefore safe and environmentally acceptable. A combination of such a cracking agent in the pretreatment phase with carrying out imbibition drawing in water is preferred from an environmental and safety point of view and also reduces cost.

To summarise, the pretreatment straining according to the invention can be carried out in many different ways which have in common a localized straining of the elongated shaped article in presence of a cracking liquid. The pretreatment can be achieved by passing the article over a knife edge under tension in presence of the cracking liquid or by drawing it very locally in presence of the same or by any other means or combination of these techniques. What is important for the process of the invention is the initiation of the craze formation, creating a very high number of crazes which will be filled during the imbibition drawing with liquid containing the additive.

The prior art (Adams U.S. Pat. Nos. 3,102,323 and 3,233,019 and Guthrie U.S. Pat. No. 4,055,702) disclosed polymeric fibers (or films) containing additives introduced by cold drawing in a cracking media. Their modifiers were not uniformly distributed along the fibers and were said to be present in short length variations of at least 10 per inch (4 per cm) along the length of the drawn fibers (or films) and up to 20,000 per inch (800 per mm). FIG. 2 of Adams (U.S. Pat. No. 3,233,019) shows collapsed drawn areas and is in agreement with our SEM photographs FIGS. 3, 4 and 6 showing our attempts to reproduce polyester fibers according to the prior art (Adams and Guthrie). But we were unable in such attempts (to reproduce the prior art) to achieve any density of "cracks" anywhere close to 20,000 per inch of fiber length. Our attempts showed very low average densities per unit length, as can be seen from our SEM photographs of FIGS. 3, 4 and 6. The lack of uniformity of density in these fiber sections leads us to believe that Adams' indicated highest density may be understood as a maximal density that could be achieved only in very short sections of fibers. Even considering such an interpretation, however, we did not find such a high density even in short lengths in our attempts to reproduce his results.

The prior art technology disclosed by Adams was essentially for producing dyed samples from polymers such as polyethylene terephthalate, nylon 66, polypropylene and polyurethane by drawing undrawn or partially drawn samples in one or more drawing baths which could be the same or different. Adams did not, for instance, suggest pre-treatment straining in the presence of a cracking agent to initiate microcracks on the surface of his sample, but he merely performed his cracking in his imbibition drawing bath. In contrast, according to our invention, we believe microcracks are probably initiated in our pretreatment straining in the presence of cracking media so our later drawing probably plays essentially a role of propagating already-formed microcracks across the whole cross-section. Our pre-treatment straining according to the invention initiates the craze formation so effectively that the presence of cracking liquid during later drawing, when the imbibition takes place, can even be avoided. This constitutes an essential advantage as discussed earlier. This essential process difference creates a structural difference which in turn can explain our product properties and advantages. In particular, the poor tensile properties of fibers made according to the prior art are believed to be directly related to weaknesses in the individual fibers, as can be seen in our FIGS. 3, 4 and 6. We believe that the lower number of "cracks" (or crazes) and their early collapse reduced the uniformity of distribution of Adams' modifier and his fibers and the maximal concentration which he could achieve under any given set of conditions. Adams recognized that the concentration of his modifier in his final drawn polymer depended on the number of the cracks or fissures (Adams 3,102,323, col 4, lines 10–14). By increasing the number and providing microcracks before drawing, the process of the invention not only achieves more uniform and better distribution of any additive in the polymer, but also reduces the size of the inclusions, resulting in different product characteristics. We believe that the size of the inclusions plays an important role in at least two applications of the technology: in lightfastness of dyed polymers and in flame retardancy. A relationship between dye fastness and agglomeration of dye molecules was known from the literature, but our finding of an effect of size distribution of flame retardant particles is believed new and not previously known.

We are aware that another limitation of the prior art was in slow drawing speed. We believe that weak points in the filaments caused broken filaments during drawing and limited the drawing speed, so it was not possible to reach a commercially-acceptable draw speed with that technology. Such a problem is not believed to exist with the present invention. We believe that our process has no real speed limitations and can be carried out at drawing speeds which can go up to as much as 2000 m/min. In contrast, we believe that the number of crazes formed when drawing according to the prior art was very dependent on the speed of drawing. Differences in the structures of the filaments, as can be seen in the SEM photographs, explain why our process need not be limited by drawing speed. We believe that this process has no real speed limitations and can be carried out at speeds which can go up to 2X of the fastest commercial processes used today (>1000 m/rain). A satisfactory pre-draw treatment has been demonstrated at 1000 m/min, on a commercial spinning machine, and by drawing at 200 m/min (the maximum available owing to limitations of available experimental equipment). No sign of approaching any speed limit for the process was detected under these conditions. In contrast, we believe that the number of crazes formed when drawing according to the prior art is very dependent on the speed of drawing, as can be seen when comparing our prior art samples drawn at 10 m/min and 70 m/min. In the case of the present invention, the number of microcracks has been controlled essentially by the pre-draw treatment and has been less dependent on the draw speed. Moreover, pretreatment straining according to the invention using a fast and localized partial drawing of 5–100% as illustrated in FIGS. 10, 11, 12 has an advantage of being able to pretreat effectively at a high speed without any particular limitations of either speed or rope ktex.

Guthrie U.S. Pat. No. 4,055,702 disclosed additives permanently incorporated into melt spun fibers by cold drawing that formed a network of microvoids which were interconnected along the entire length and throughout the cross section of the fiber. His drawing was done in a single bath, which might or need not contain the additive. In the latter case, the fibers were drawn in the cracking media and then immersed in a bath containing the additive. Thus Guthrie taught only 2 alternative techniques for incorporating his additives into his fibers, either incorporating additives during cold drawing of his fibers in the presence of the appropriate media, or, as an alternative, treating his fibers with his diluent-additive combination subsequent to being drawn. Guthrie, like Adams, did not pretreat his fibers prior to drawing (to initiate microcracks and control his crack-drawing process).

The two Adams patents only disclose part of the technical effort by DuPont in the field of crack drawing. This effort covered a very large number of cracking liquids and various polymers, but did not produce products or processes which were considered commercially acceptable. The main reasons were the poor mechanical properties of the fibers and difficulties in achieving an acceptable process. The mechanical properties which were measured in practice were 30–50% inferior as compared to the commercial controls. The invention has overcome these limitations, since the pre-drawing treatment initiates a very high number of microcracks and in a controlled way. This enables one to avoid creating weak points in the filaments or films, which would be the first to break when elongated.

Hollow fibers are of special interest as feed filaments for the invention. Hollow fibers are used today on a large scale for many applications such as polyester filling fibers, textile fibers, polyamide carpet fibers and the like. We have already investigated in detail treating commercially-available hollow polyesters with a round cross-section having a single hole, and multi-void fibers containing 4-holes and 7-holes (all of 6 dtex and about 13–15% void), and have compared the results with those obtained by treating solid fibers of similar deniers. Surprisingly, hollow staple fibers have performed far better than the solid fibers. We believe that this may be because of the ability of the liquid to flow inside the void, as mentioned hereinafter. Comparing the concentration of methyl phosphonic acid, infused in isopropanol, in a solid polyester fiber and a 4-hole polyester fiber, we discovered the hollow fiber contained 3.3 times the concentration of the additive, as compared with the solid fibers. SEMs of the cross-sections of the hollow fibers showed that the holes were (on average) 50% filled with the additive. This seems to have accomplished a "dream", whereby producers have tried (without success previously) to fill these holes with another phase. Hitherto, the only practical possibility has been to spin bicomponent fibers, such as antistatic carpet fibers containing a carbon/polyethylene core and a polyamide sheath. Hollow fibers specifically respond well to our process, as illustrated by the fact that the above results were achieved with a spinning speed of 1100 m/min, for the 4-hole fiber and 800 m/min for the solid. When the solid fiber was spun at a speed of 1100 m/min the concentration of phosphorus (P) decreased from 1.0% to 0.6%. In contrast, a similar speed change did not effect P the concentration in the hollow fiber.

This aspect of the invention is expected to be extremely useful because it allows one to load the fibers with a higher concentration of flame retardant or other additive with little or no interference with the polymer structure and using the same spun supply. There is no need for complicated and expensive spinning techniques and the process has the flexibility and the advantages of permitting combining different additives in a single process as discussed earlier.

We believe that these results are probably caused essentially by sideway flow along channels of the cracking liquid and the additives incorporated therein, once they reach these channels through the microcracks. This sideway flow probably encounters lower resistance than flow through the microcracks and therefore the liquid may tend to fill the channels and accelerate further infiltration of liquid through the microcracks.

The concentration of additive in the holes may have important specific commercial applications in conductive fibers, antibacterial fibers and other end-uses. In the case of electrically-conductive fibers, whereby the fiber can be infused with a high concentration of metal salt, for example, filling the holes is expected to create continuity of conductive product such as cannot be obtained in fibers of solid cross sections. Another possibility to create a continuous phase of conductive material in the fiber channels is by using imbibition drawing to fill hollow spun feed filaments with materials such as substituted anilines or pyroles as additives, then polymerizing the materials, in situ.

In applications such as antibacterial fibers, channels filled with a bactericidal chemical can be expected to serve as a reservoir from which the active ingredient can slowly migrate to the outside and provide almost permanent presence of some of the bactericidal chemical on the fiber surfaces. In staple applications, the direct migration of the bactericidal chemical from the filled holes into the surrounding media should provide effective control of bacterial or fungi growth. The prior art does not disclose any satisfactory technique which allows one to form such a regular and continuous phase which could serve as a reservoir.

As indicated hereinbefore, alternatively or in addition to pretreating the feed article by straining, as hereinbefore already discussed in detail the feed article may be pretreated to effect polarization of its surface by irradiation bombardment. We have found Corona irradiation to be particularly effective.

This type of pretreatment essentially consists of irradiating the undrawn or partially drawn feed article (fibers or film) one or more times either on the same side of the article or on both sides, with different results as will be apparent. This pretreatment consists of attacking the surface of the "dry" feed fibers with electrons or photons or ions; by "dry", we mean that cracking liquid is not present during this irradiation predraw treatment. The (films or) fibers are then drawn in the cracking liquid as discussed already, but should be drawn promptly while the surface is still activated. Corona surface irradiation bombardment treatment has proven to be particularly effective, although other irradiation treatments could also possibly be used. It is known from the literature that Corona and similar ionizing treatments are capable of etching the fiber surface and inducing some physical and chemical changes of the fiber surface. For example, Corona has been used to treat hydrophobic films prior to printing or bonding to increase their affinity for dyes or bonding agents. It is believed that the increased affinity is due to the "electrons" (for example) breaking the polymer chains to shorter chains or breaking C-H bonds. Extra hydroxyl groups and free radicals are formed on the surface of the filaments and increase the polarity of the polymer surface and thus increase its affinity for the cracking liquid. We believe that the radicals and ions formed on the surface (which are not permanent, but decay over a period of time) play a major role in increasing interaction between the cracking agent and the surface of the polymeric article in a way which we do not yet fully understand. It has however been suggested that wetting of hydrophobic polymers depends on decay time after Corona treatment, and we believe that the better the wetting the more effective is the action of the cracking liquid according to our invention. There could be several ways theoretically to explain why the amount of modifier that can be imbibed into fiber pretreated with Corona decreases with time, as discussed, herein.

Pre-draw treatments which are based on Corona treatments are easy to control by objective and precise measurements such as energy applied, fiber speed, electrode selection, distance of electrodes to fibers, and frequency used. The results of the treatments do not depend on tension (which may sometimes be difficult to control for undrawn fibers), knife wear or angle of traverse, etc. Irradiation methods, and Corona in particular, allow a relatively high speed and are relatively inexpensive. So we believe that a process based on such a pre-draw treatment will reproducible and relatively easy to control.

We have made trials which have showed advantages, from a practical point of view, in using Corona, which is easily available and has been particularly effective for polyester. Our process is of commercial interest for these reasons:

1. It is environmentally friendly, because it reduces the use of solvents in the drawing area, which we expect to help in recovery of unused modifying chemical additives, and the cracking liquids.

2. It is a controlled reproducible process, that is not dependent on tension of the film or fiber bundle (which can be difficult to control with an undrawn polymeric material), and can be controlled by measurable parameters such as energy applied, pulse frequency, distance between electrodes, speed of fibers or films (time or exposure), etc., and there is little or no need to make frequent adjustments to the process to compensate for wear of knives, tension, spreading of fibers on the knives, and their potential to create broken filaments.

The irradiation treatment according to the invention using Corona or like means, applied mainly or entirely to only one side of an elongated article, such as a fiber, also permits spirally-crimped fibers to be made in high denier (>6 dtex) hollow fibers, which is an entirely new and interesting aspect.

It is possible to perform the irradiation pretreatment immediately after spinning or several weeks later without essentially changing the process techniques, although some adjustment of the concentration of the additive in the first drawstage may be required to keep the final concentration in the fiber within desired control limits.

It seems however desirable to perform the imbibition drawing as soon as possible after the irradiation, (e.g., in a coupled or on-line process). This is not fully understood yet, and is discussed further herein. For polyester, for example, we prefer to carry out imbibition drawing as rapidly as possible, and within a period such as 1 or 2 weeks or less e.g., within 48 hours. Those skilled will recognize that the delay time may likely depend on several factors, including the nature of the synthetic polymer.

A preferred method consists of irradiation, followed by drawing in a bath containing a solution or an emulsion (or dispersion) of the additive in a cracking agent. This allows good control of the concentration of the additive in the polymeric material. After the irradiation treatment and first drawing step have been completed, the fibers may be further drawn in one or more steps as already discussed hereinabove.

As mentioned already, an irradiation pretreatment may be combined with other pretreatment, such as straining on one or more knife edges in presence of a cracking agent or partial drawing pretreatment, as a prelude to imbibition drawing.

We are aware that a limitation of the prior art was in slow drawing speed. We believe that weak points in the filaments caused broken filaments during drawing and limited the drawing speed, so it was not possible to reach a commercially-acceptable draw speed with that technology. A variety of chemical additives can be introduced into the fibers and reach a high concentration whether they have an affinity for the fibers or not. The additives should generally have dimensions of less than 600 Å, but may sometimes be larger. The concentration of a given chemical in the fibers, in a given cracking liquid and process conditions, generally depends essentially on the concentration of the chemical in the drawing or predraw treatment media and the viscosity of the media. High viscosity generally limits the rate of infusion under given conditions and consequently the concentration in the fiber under given process conditions.

An important expected commercial application of the technology of the invention is the production of flame retardant fibers. The literature concerned with flame retardant polyester is very rich, but it is interesting to remark that no matter how the flame retardant product has been introduced into the fiber, and even at very high concentrations of the flame retardants, a level of 30 LOI has never been reached. The highest LOI value quoted by R. T. Guthrie in U.S. Pat. No. 4,055,702 for modified polyester is 28.8. In DE 4005377 A1, Michels et al reported a range of acrylics modified with organic phosphorous chemicals with up to 2.85% phosphorous reaching a maximum of 25.5 LOI. In another reference, Birum in U.S. Pat. No. 4,073,767 used various cyclic phosphonates at concentrations of up to 10% on polymer weight with a maximum LOI of 25.7. Gresham in U.S. Pat. No. 3,944,633 reported plates with up to 2% phosphorus and maximal LOI of 29.2. Liepins et al, J. Appl. Polymer Science, Vol. 22, 2403–2414 (1978), reported grafting of polyethylene terephthalate with various vinyl phosphonates, either on the surface or distributed through the structure. The add on was 3 to 28% of vinyl phosphonate, but the highest LOI achieved was only 28.3.

The method of the invention makes it possible to achieve a LOI of 37–40 with simple organic chemicals such as methyl phosphonic acid, at a level of only 1% P. Such high LOI values with relatively low % P have been repeated many times with polyesters, and are not yet fully understood.

It is well known that polyamides have a structure which is much more open than polyethylene terephthalate and that they have a higher affinity for water. Water can also be considered as a swelling agent for polyamides, but it has a very low affinity for polyester. For these reasons, water-soluble or water-emulsifiable additives which are infused into polyester by the process of the invention may show excellent resistance to extraction during dyeing, laundry or dry cleaning. This is quite different from polyamides, particularly during dyeing at the boil of polyamide fabrics or carpets, which may take several hours if dye shades corrections are required using conventional techniques.

The extraction of a water-soluble additive from a polyamide fiber, produced according to the process of the invention, should depend on many factors. The nature of the additive, the cracking agent used, the polyamide structure, dyeing or laundry conditions, may all have an impact on losses due to extraction. To control or eliminate completely losses of infused additives during wet processing of polyamides, it is desirable to fix the additives inside the fiber by a chemical reaction in situ, after the drawing. Chemical reactions which can be used are generally of two types; polymerization, which can be carried out during heat treatment (annealing, crimp setting) in presence of a catalyst or an initiator, and cross-linking reactions, whereby a cross linker is activated by the heat treatment.

An example of the first category is a vinyl phosphonate which can be infused into the fiber according to the process of the invention in the presence of a small amount of a polymerization initiator such as peroxybenzoyl, and polymerized inside the fibers during annealing, or crimp setting. This will not only block the flame retardant inside the fibers and reduce or avoid losses during wet treatments, but will also increase the wettability of the fibers.

An example of the second type of reaction is when additives containing an active hydrogen group, such as alcohols or amines, are infused into the fibers with a blocked cross linker which flees the reactive cross-linking groups at temperatures clearly above the boiling temperature of water and/or which ever other solvent is used in the formulation of the cracking agent. A good example of such a product, which we found very effective, is Meikanate MF sold by Meisei Chemicals, Kyoto, Japan. This product is based on diphenyl methane 4,4' methyl ethyl ketoxim carbamate and flees the very reactive diphenyl methane diisocyanate when heated above 120° C.

Such chemical reactions can be either done in two steps, whereby the additive is infused at the same time as the cross linker or the polymerization initiator, or the two chemicals can be infused in two consecutive steps, for example in two consecutive draw baths.

A post infusion chemical reaction can be used whenever required by the processing or the cleaning of the article, so long as the chemical reaction would not undesirably affect the desired properties, e.g., loss of flame retardancy, loss of antibacterial activity, and the like. For instance, use of an additive that will condense with amine end groups may be especially advantageous, for instance with flame retardants.

DESCRIPTION OF TEST METHODS

"Experimental LOI" measurements herein:

LOI stands for "Limiting Oxygen Index" and is a standard measurement developed for testing fabrics (and plastic resins) and is known to depend on the construction of the fabric. Guthrie, for example, describes how he tested for and calculated LOI at the top of col 11 of U.S. Pat. No. 4,001,367. To avoid delay and problems in making fabrics from each of the experimental fibers, we used the following method herein to measure an Experimental LOI value directly on the fibers.

A filament bundle of about 15,000 dtex was woven into a glass fabric, by using a big needle to replace one of the warp glass fiber yarns with the test specimen. The space created for the test sample was 6 mm wide for all samples, to ensure the same sample density. The resulting (mostly glass) fabric was then placed on the standard sample holder and the test continued according to the standard procedure. This procedure resulted in very regular burning and gave very reproducible results. On average, an "Experimental LOP" is 1–3 units higher than when LOI is regularly measured on fabrics made from the same items using the standard procedure.

EXAMPLES

The invention is further illustrated in the following Examples, all parts and percentages being by weight unless otherwise indicated. The methyl phosphonic acid flame retardant contained not more than 5% of pyro methyl phosphonic and methyl polyphosphonic acids.

Comparison Example 1

An undrawn bundle of 2000 filaments and about 7.3 dtex/filament, that had been spun at a speed of 800 m/minute, was drawn (draw ratio of 2.6X) in isopropanol containing 10% of the methyl phosphonic acid flame retardant at room temperature at a speed of 60 m/minute. The drawn filaments were washed in water for 10 minutes and dried at room temperature. The phosphorus concentration (% P) in the drawn filaments was 0.7%, corresponding to a concentration of about 2.3% of the flame retardant.

Example 2 (according to the Invention)

Example 2 demonstrates the increase obtained in concentration of flame retardant (expressed as % P) at the same draw ratio of 2.6X by using a knife-edge-type crazer. The crazer was a folded stainless plate with a rounded edge having a diameter of 0.5 mm, and the filaments were tensioned and spread out into a single layer as they passed over the crazer by being passed under appropriately-positioned rolls in the pretreatment bath before and after being passed over the crazer (also in the bath).

An undrawn bundle (as in Example 1) was pretreated by passing the bundle first over the crazer (diameter of 0.5 mm) and in a bath of isopropanol (without the flame retardant) then maintaining it under a slight tension for 1.5 seconds prior to drawing, washing and drying as in Example 1. The % P was 1.1%, corresponding to a concentration of about 3.5% of the flame retardant.

A series of experiments from which these two Examples were taken showed that the concentration of crazes in filaments drawn without the crazer (as in Example 1) was very scattered, and had poor reproducibility in contrast to the filaments drawn according to the invention, as in Example 2.

Example 3

An undrawn bundle (as in Example 1 and 2) was pretreated by passing the bundle first over a crazer with two knives (having diameters of 0.8 mm) as in FIG. 9, using water/butanol/Amgard CU in weight ratios of 90/10/20 as a cracking liquid.

The bundle was then drawn in a bath of the same composition to DR=2.6X and then further drawn in steam to DR=1.42X. Drawing speed was 100 m/min. After washing the fibers at 40 degrees C. the phosphorus concentration found was 1.11%, corresponding to a concentration of about/5.3% of the flame retardant. The Experimental LOI of the washed sample was measured to be 35.7%.

Example 4

Same as Example 3 except that the concentration of the flame retardant was only 10%. The resulting phosphorus concentration was 0.74% and the Experimental LOI was measured to be 31.7%.

While Examples 2–4 were carried out using a knife edge type crazer, as illustrated in FIG. 9, Example 5 involved high deformation drawing, as illustrated in FIG. 10, and incorporated into a lab drawing machine as illustrated in FIG. 11. As demonstrated by Example 5, this technique can be so effective that it achieved 0.97% of phosphorus, (about 4.6% of Amgard CU) when carrying out imbibition in water without any presence of butanol in the drawing liquid, and this result was achieved although the draw ratio used in the imbibition step was only 1.75X versus 2.6X used in Examples 3 and 4.

Example 5

An undrawn filament bundle (as in Example 1) was first passed on a crazer as in FIG. 10, using water/butanol 93/7 as a cracking liquid, and was drawn in the pretreatment stage to a DR=1.26X. The bundle was then drawn in a 20% solution of Amgard CU in water to a DR=1.75X, then further drawn in steam to DR=1.7X. Drawing speed was 100 m/min. After washing the sample at 40 degrees C. a phosphorus concentration of 0.97% was found.

Whereas Examples 1–5 treated polyester filaments, Example 6 shows treatment of nylon filaments. This Example was made using the crazer illustrated in FIG. 9 ( knife-edge crazer).

Example 6

An undrawn bundle of 2450 dtex of nylon 66 was conditioned at 30% RH for 12 hours. The bundle was then pretreated and drawn in isopropanol containing 10% of "Antiblaze" 19 at a draw speed of 100 m/min and a draw ratio of 2.5X. The drawn nylon was then passed over a hot plate heated at 150° C. The resulting yarn contained 1.9% P and did not burn when exposed to a large lab burner.

Instead of a laboratory operation, Example 7 used a pilot commercial set up and is included to show that the tensile properties of the filaments need not be reduced by the imbibition treatment of the invention to the extent experienced in carrying out prior imbibition teachings, without pretreatment according to the invention. It also demonstrated that the results achieved in the laboratory by the process of the invention can be translated into a commercial process achieving comparable flame retardancy.

Example 7

A fiber bundle of 84 ktex and 8.5 dtex/filament was spread by passing it through a series of bars and rolls then pretreated on a 80 cm wide crazer with two edges, (similar to FIG. 9) having a diameter of 0.6 mm, in presence of water/butanol 93/7, followed by drawing to DR=2.6X in presence of a solution of water/butanol/Amgard CU in the weight ratios of 93/7/13. The fiber bundle was then further drawn in steam to DR=1.5X to reach a final DR=3.9X. The fibers were then washed on line, sprayed with finish, crimped and heat set in an oven for 10 minutes at 130 degrees C. Draw speed was 200 m/min. The resulting rope was cut to 32 mm cutlength and baled in standard commercial bales. The fiber was processed 10 days later into ring spun yarns which were used for the preparation of knitted and woven fabrics. Phosphorus concentration was 0.73% and the Experimental LOI of the fibers was measured to be 32.4%. The tenacity of the fibers was 45 cN/tex.

Example 8

The staple fibers of Example 8 were sprayed in a laboratory with a 7% emulsion of a dimethyl polysiloxane at a level of 0.6% per weight of the slickener (about 0.3% Si). The fibers were then heated in an oven for 10 minutes at 170 degrees C. to cure the silicone and carded on a lab card to form a 20 mm thick batting.

The resulting batting was very slick exhibiting the usual handle of siliconized low denier fibers. The Staple Pad Friction of the dry product was 0.59 and of the corresponding siliconized product 0.32.

The siliconized fiber batt exhibited a surprising resistance to ignition; it did not catch fire with the methanamine pill test and did not burn when exposed to a 40 mm gas flame in a vertical test for 15 seconds using the equipment and a modified procedure of DIN 4102 (the only difference being that the flame was 40 mm instead of the specified 20 mm).

Table 1 illustrates the effectiveness of the invention in increasing the number of crazes per mm length of drawn polyester fiber from less than 50/ram to over 100/mm, as counted on SEM photographs, when a single crazer was applied to one side of a bundle of 2000 polyester filaments, of about 7.3 dtex/filament, using a knife-edge crazer as used in Example 2 (diameter of 0.5 ram) and, as cracking liquids, isopropanol or water/butanol (93/7). To facilitate the counting of the crazes on the SEM photographs, the filaments were drawn to 50% only in a single bath. No additive was used, i.e., only the cracking liquid was used, as the only objective was to demonstrate the effectiveness of the crazer in increasing the number of crazes. Such a significant increase does, however increase the ability to increase infusion of additives into the filaments, to improve their properties.

TABLE 1

| Draw Speed | Cracking Liquid | No. of Crazes Without/With crazer |
|---|---|---|
| 10 m/min | Isopropanol | 5–10/770 |
| 50 m/min | Isopropanol | 20–25/1000–1100 |

TABLE 1-continued

| Draw Speed | Cracking Liquid | No. of Crazes Without/With crazer |
|---|---|---|
| 20 m/min | Water/butanol (93/7) | ~40/~450 |

Example 9

Two types of undrawn continuous filament bundles were prepared on a commercial machine for spinning polyester fibers in the following manner:

1. Filament bundles containing 2000 filaments (7.3 dtex/filament, solid round cross-section, undrawn) were spun at 1000m/min using a 2000 hole spinneret (for making final fully drawn 1.6 dtex/filament solid round cross-section polyester fibers).

2. Filament bundles containing 700 filaments (21.5 dtex/filament, undrawn hollow) were spun at 900 m/minute using a 700 hole spinneret (for final fully drawn fiber 6.1 dtex/filament hollow (single hole) circular cross section fibers).

The filamentary bundles were wound up to form "cakes" (at, respectively, 1000 m/rain, and 900 m/min) using just sufficient tension to create well-formed cakes and to prevent sloughing, but insufficient to effect drawing. Cakes were prepared such that a filamentary ribbon could be unwound by unrolling. Some time delays occurred between the various stages of preparing the samples, i.e., between spinning the filaments (to form the cake) and irradiation pretreatment, and between the pretreatment and drawing. "Corona" treatment was performed on a laboratory machine at Softal Electronic GmbH, Germany, using 2 multiblade high efficiency electrode stations located sequentially on opposite sides of the filament bundle, so each partially and preferentially treated a maximum number of filaments on half their fiber circumference. The distance between the electrodes and the filaments (passing over a metal conductive roller) was 1.5 mm. The filament processing speed was 50 m/min, so that the "Corona" pre-treated filaments could be rewound (it should be noted that speeds of up to 750 m/min have been reported in trade literature for Corona treating paper and films, see especially Softal trade bulletins entitled "Development Progress in the areas Electrode/Dielectric" and Softal report on "The Multi-Blade High efficiency Electrode"). The irradiation energy used was 83 watts.min/$m^2$. It was, however, noted that (dependent on fibre effects desired) the optimum level varied with different fiber deniers, cross-sections, etc. A pulse frequency of 22 Hz was used. The machine settings used were by way of example and not intended to be limiting.

The filaments were drawn to 170% elongation in 10/90 butanol/water +20% ANTIBLAZE® (available from Albright and Wilson) solution at pH 4.0 (without any mechanical pre-treatment).

The % pick-up was 8.7% for such fibers drawn 48 hours after "Corona" pre-treatment according to the invention, vs 5.3% for control fibers drawn without Corona pretreatment.

It is known that any residual wetting effect on hydrophobic polymers depends on (decreases with) the decay time after Corona treatment, and it is possible that the better the wetting the more effective is the cracking liquid. It has been conjectured that "short chain decay product & radicals are strongly polar and as a result of their mobility their polar ends tend to be directed toward the polymer which in turn leads to a sharp drop in surface tension with time" (article by K. Gerstenberg Coating 5/91). This could at least partly explain why the amount of modifier imbibed into fibers pretreated with Corona appears to decrease with time.

It is evident that the scope of the invention is not limited to the above process only, nor to polyester in any form, and that similar treatments could be applied to other fiber-and film-forming polymers, with adjustment of the process conditions to suit the polymer properties and the form of the material. The results of the pretreatment may, however, depend on physical properties of the fibers; such as orientation, denier, finish on fiber surface and additives contained therein.

What we claim is:

1. An improved process involving imbibition drawing of an undrawn or partially drawn elongated shaped article (hereinafter "said feed article") of synthetic organic polymer, whereby finely divided amounts of additive are imbibed into the shaped article as it is drawn in the presence of a fluid and of the additive, wherein said feed article is pretreated, before performing the imbibition drawing, to improve the quality of crazing in the resulting article by being so pretreated.

2. A process according to claim 1, wherein said pretreating comprises straining said feed article, while it is wetted with cracking fluid, before performing the imbibition drawing.

3. A process according to claim 2, wherein said straining is performed so as to effect partial drawing during said pretreatment of said feed article.

4. A process according to claim 3, wherein said straining is performed by drawing said feed article between 1.01X and 2X.

5. A process according to claim 3 or 4, characterized by performing said straining by passing said feed article first between a set of feed rolls and then between a set of draw rolls, both said sets of rolls being driven at controlled speeds, said draw rolls being driven at a controlled speed that is higher than the controlled speed of said feed rolls, and by wetting said feed article with cracking fluid at a location that is sufficiently close to the draw rolls to effect drawing at said location.

6. A process according to claim 5, characterized by protecting said feed article from being splashed by cracking fluid other than at said location.

7. A process according to any of claims 1–4, wherein the total draw ratio during pretreating and imbibition drawing is at least 2X.

8. A process according to claim 3 or 4, wherein, after said pretreating, the additive is imbibed into the article as it is drawn in the presence of water containing the additive.

9. A process according to claim 2, wherein the said feed article is strained, while wetted with cracking fluid, by passing it over an edge to produce the formation of microcracks in its surface.

10. A process according to claim 9, characterized by straining more than one side of said feed article by passing it over more than one edge while wetted with cracking fluid.

11. A process according to claim 10, wherein said feed article is strained on a first side thereof by passing it over a first edge, and then is strained on a second opposite side thereof by passing it over a second edge located so as to contact said opposite side.

12. A process according to any of claims 9–11, wherein the edge is of metal and has a diameter of 0.1 to 2 mm.

13. A process according to any of claims 1 or 4, wherein the additive is imbibed into the article as it is drawn in the presence of a cracking fluid containing the additive, after said pretreating has been performed.

14. A process according to claim 13, wherein a cracking liquid is used for imbibition drawing and contains said additive dissolved or dispersed therein.

15. A process according to claim 13, wherein cracking fluid used for pretreating is also used for imbibition drawing.

16. A process according to any of claims 1 to 4, characterized by using as cracking fluid a $C_2$–$C_8$ alcohol containing one or more hydroxyl group.

17. A process according to any of claims 1 to 4, characterized by using as cracking fluid an aqueous solution of a $C_2$–$C_8$ alcohol containing one or more hydroxyl group and containing more than 50 percent by weight of water.

18. A process according to any of claims 1 to 4, wherein the feed article is pretreated, before performing the imbibition drawing, by irradiating the feed article to polarize its surface.

19. A process according to any of claims 1 to 4, characterized by further drawing the resulting shaped article in the presence of water or steam, after performing the imbibition drawing.

20. A process according to any of claims 1 to 4, wherein said shaped article is a filament containing one or more voids.

21. A process according to any of claims 1 to 4, wherein said shaped article is a bundle of filaments, and characterized by squeezing the resulting drawn bundle of filaments to remove excess fluid, washing to remove any excess additive, and crimping after optionally drying the washed filaments.

* * * * *